US007165764B2

(12) United States Patent
Nakamura et al.

(10) Patent No.: US 7,165,764 B2
(45) Date of Patent: Jan. 23, 2007

(54) SHEET PROCESSING APPARATUS WITH BUFFER FOR SHEET FINISHER

(75) Inventors: Tomokazu Nakamura, Chiba (JP); Yoshinori Isobe, Ibaraki (JP); Toshimasa Suzuki, Chiba (JP); Masatoshi Yaginuma, Ibaraki (JP); Masahiro Yonenuma, Chiba (JP); Atsushi Takada, Ibaraki (JP); Norio Motoi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 10/790,001

(22) Filed: Mar. 2, 2004

(65) Prior Publication Data

US 2004/0175217 A1 Sep. 9, 2004

(30) Foreign Application Priority Data

Mar. 7, 2003 (JP) ..... 2003-108397

(51) Int. Cl.
*B65H 37/04* (2006.01)

(52) U.S. Cl. ..... 270/58.11; 270/58.14; 270/58.18; 270/58.08; 271/189; 399/410

(58) Field of Classification Search ..... 270/58.01, 270/59, 58.08, 58.11, 58.12, 58.14, 58.16, 270/58.17, 58.18, 58.27; 399/410; 271/189
See application file for complete search history.

(56) References Cited

U.S. PATENT DOCUMENTS 5,112,034 A * 5/1992 Uto et al. ..... 270/58.12
5,289,251 A * 2/1994 Mandel et al. ..... 399/407
5,580,042 A 12/1996 Taniguro et al. ..... 271/274
5,592,280 A 1/1997 Ishizuka et al. ..... 399/410
5,605,322 A 2/1997 Suzuki et al. ..... 270/58.13
5,620,174 A 4/1997 Taniguro et al. ..... 271/10.12
5,765,824 A * 6/1998 Kawano et al. ..... 270/58.11
5,999,760 A 12/1999 Suzuki et al. ..... 399/45
6,219,503 B1 4/2001 Miyake et al. ..... 399/85
6,233,427 B1 * 5/2001 Hirota et al. ..... 399/407
6,264,189 B1 7/2001 Kawata ..... 271/176
6,315,288 B1 * 11/2001 Sugishima et al. ..... 271/303
6,330,422 B1 12/2001 Sato et al. ..... 399/382
6,332,606 B1 * 12/2001 Seki ..... 270/59
6,371,472 B1 4/2002 Miyake et al. ..... 270/58.14
6,386,080 B1 5/2002 Okamoto et al. ..... 83/73
6,398,214 B1 6/2002 Moteki et al. ..... 271/220
6,471,429 B1 10/2002 Isobe et al. ..... 400/582
6,517,065 B2 2/2003 Miyake et al. ..... 270/58.09

(Continued)

FOREIGN PATENT DOCUMENTS

JP 05286619 A * 11/1993

(Continued)

*Primary Examiner*—Patrick Mackey
(74) *Attorney, Agent, or Firm*—Fitzpatrick, Cella, Harper & Scinto

(57) ABSTRACT

A sheet processing apparatus is provided with a processing tray on which sheets are to be stacked and subjected to a processing, a stack tray provided in the downstream of the processing tray with respect to the sheet conveying direction on which sheets are to be stacked, an oscillation roller pair for conveying the sheets stacked on the processing tray to the stack tray, and a trailing edge assist for conveying the sheet stacked on the processing tray toward the stack tray. The sheets stacked on the processing tray are discharged to the stack tray by the oscillation roller pair and the trailing edge assist.

26 Claims, 31 Drawing Sheets

U.S. PATENT DOCUMENTS

| | | | | |
|---|---|---|---|---|
| 6,603,951 | B2 | 8/2003 | Sato et al. | 399/382 |
| 2002/0129690 | A1 | 9/2002 | Yaginuma et al. | 83/628 |
| 2003/0049063 | A1 | 3/2003 | Suzuki et al. | 399/407 |
| 2003/0168796 | A1 | 9/2003 | Suzuki et al. | 270/58.07 |
| 2004/0181308 | A1* | 9/2004 | Hayashi et al. | 700/223 |

FOREIGN PATENT DOCUMENTS

| | | |
|---|---|---|
| JP | 9-48545 | 2/1997 |
| JP | 2003-081517 | 3/2003 |

* cited by examiner

SHEET PROCESSING APPARATUS WITH BUFFER FOR SHEET FINISHER

BACKGROUND OF THE INVENTION

1. Field of the Invention

The present invention relates to a sheet processing apparatus that is detachably equipped on the main body of an image forming apparatus such as a copying machine or a printer, and to an image forming apparatus equipped with such a sheet processing apparatus. Particularly, the present invention relates to a sheet processing apparatus that can discharge sheets reliably and an image forming apparatus equipped with such a sheet processing apparatus.

2. Related Background Art

Recently, sheet processing apparatuses such as sorters for sorting sheets, on which images have been formed, have been developed as optional apparatuses for image forming apparatuses such as electrophotographic copying machines or laser printers. Such kinds of sheet processing apparatus is designed to perform at least one processing such as sorting, stapling or jogging etc. on sheets.

A sheet processing apparatus having a stapler for stapling sheets is designed in such a way that the stapling operation is performed after the sheets conveyed into the body of the sheet processing apparatus have been made to pass through a conveying path provided in the interior of the body and then stacked on a post-processing tray.

The sheet processing apparatus for stapling a stack of sheets is adapted to place sheets in a stack on the post-processing tray and moving a stapler serving as stapling means to perform stapling at one position or multiple positions (typically, at two positions). During the stapling operation, it is not possible to place the sheets for the next job on the post-processing tray. Consequently, it is necessary to set intervals between sets of sheets on a job by job basis for stapling operations.

However, the intervals set between sheets invites a decrease in productivity. In other words the number of sheets processed per unit time is decreased. A sheet processing apparatus as shown in FIG. 31 has been proposed as a sheet processing apparatus that will avoid such a decrease in productivity (see, for example, Japanese Patent Application Laid-Open No. H9-48545).

The conventional sheet processing apparatus 10 shown in FIG. 31 has a buffer roller path 14 provided in a conveying path 12 in the midway of the sheet conveying path to a post-processing tray 11. In the buffer roller path 14, sheets are wrapped around a rotating buffer roller 13 so as to be kept in a waiting state before conveyed to the post-processing tray 11.

With the above-described structure, in the conventional sheet processing apparatus 10, sheets conveyed from a sheet discharge roller pair 17 provided in the main body 16 of an image forming apparatus 15 are stored in the buffer roller path 14, so that a set of sheets stored on the buffer roller 13 are conveyed to the post-processing tray 11 after the processing, such as stapling for example, of the preceding set of sheets on the post-processing tray 11 has been completed and the preceding set of sheets has been discharged from the post-processing tray 11 by a rotating upper roller 18*a* of an oscillation roller pair 18 that holds the sheets in cooperation with a lower roller 18*b*. Thus, the intervals between sheets are not extended during the stapling operation, and a decrease in productivity can be avoided.

However, with the provision of the buffer roller path 14, this conventional sheet processing apparatus 10 suffers from the problem that it is necessary to arrange an installation space for the buffer roller 13 and the buffer roller path 14 for suspending the conveyance of the succeeding sheets to the post-processing tray 11 so as to keep them in a waiting state during the stapling operation, and so the size and the cost of the sheet processing apparatus are increased.

In addition, in the prior art sheet processing apparatus 10, since sheets are discharged by means of the oscillation roller pair 18, the sheet conveyance rate can vary due to a variation in the friction between the upper roller 18*a* and the lower roller 18*b* or a variation in the rotation speed of them, so that a displacement between the upper portion of the sheets and the lower portion of the sheets can occur. Therefore, sheet discharge operation is not stable and there is a variation in the time required for discharging sheets.

Furthermore, even the conventional sheet processing apparatus 10 that is adapted to place the sheet stored in the buffer roller path onto the post-processing tray 11 after the sheets on the post-processing tray 11 have been discharged cannot meet recent requirements for an increase in the processing speed, and an apparatus with a reduced processing time has been demanded.

SUMMARY OF THE INVENTION

An object of the present invention is to provide a sheet processing apparatus that can discharge sheets reliably.

Another object of the present invention is to provide an image forming apparatus having an improved productivity with equipment of a sheet processing apparatus that can discharge sheets stable.

According to the present invention that is intended to attain the aforementioned object, there is provided a sheet processing apparatus comprising sheet holding means for holding a plurality of supplied sheets in a stack, first sheet stacking means on which sheets that have been held by the sheet holding means or have passed through the sheet holding means without being held are stacked and subjected to a processing, second sheet stacking means, provided downstream of the first sheet stacking means with respect to a sheet conveying direction, on which sheets are to be stacked, first sheet conveying means for conveying the sheets stacked on the first sheet stacking means to discharge the sheets to the second sheet stacking means, and second sheet conveying means for conveying the sheets stacked on the first sheet stacking means toward the second sheet stacking means, wherein after the sheets stacked on the first sheet stacking means are conveyed by the second sheet conveying means toward the second sheet stacking means by a predetermined amount, the first sheet conveying means conveys the sheets held by the sheet holding means and the sheets stacked on the first sheet stacking. means simultaneously under a state in which a downstream edge of the sheet stacked on the first sheet stacking means protrudes in a downstream side beyond a downstream edge of the sheets held by the sheet holding means by a predetermined amount to thereby discharge the sheets stacked on the first sheet stacking means to the second sheet stacking means and to stack the sheets held by the sheet holding means onto the first sheet stacking means.

In the sheet processing apparatus according to the present invention that is intended to attain the aforementioned object, the second sheet conveying means may be adapted to push a trailing edge, with respect to the sheet conveying direction, of the sheets stacked on the first sheet stacking means to thereby convey those sheets.

The sheet processing apparatus according to the present invention that is intended to attain the aforementioned object may further comprise control means for controlling the second sheet conveying means in such a way that the second sheet conveying means conveys the sheets stacked on the first sheet stacking means until the downstream edge of those sheets protrude in the downstream side beyond the downstream edge of the sheets held by the sheet holding means by a predetermined amount.

According to the present invention that is intended to attain the aforementioned object, there is also provided an image forming apparatus comprising image forming means for forming an image on a sheet and a sheet processing apparatus for performing a processing on a sheet on which an image has been formed by the image forming means, wherein the sheet processing apparatus comprises any one of the aforementioned sheet processing apparatus.

The sheet processing apparatus according to the present invention is constructed in such a way that after the sheets stacked on the first sheet stacking means are conveyed by the second sheet conveying means toward the second sheet stacking means by a predetermined amount, the sheets held by the sheet holding means and the sheets stacked on the processing the first sheet stacking means are conveyed simultaneously by the first sheet conveying means so as to be discharged to the second sheet stacking means. Consequently, the overlapping area of the sheet stack and the buffer sheets is reduced by an amount corresponding to the predetermined conveyance amount of the sheet stack, and therefore the sheet stack can be detached from the buffer sheets reliably and discharged to be stacked onto the second sheet stacking means reliably. In addition, since sheets are conveyed by the first sheet conveying means and the second sheet conveying means, the sheets can be discharged quickly without variations in sheet discharge time. Therefore, it is possible to provide an apparatus with reduced processing time.

BRIEF DESCRIPTION OF THE DRAWINGS

FIG. 13A shows a state in which a first sheet has been delivered to the sheet processing apparatus; and FIG. 13B shows a state in which the first sheet has been received.

FIG. 14A shows a state in which the first sheet has passed through the first discharge roller pair; and FIG. 14B shows a state in which the first sheet has fallen in a manner bridging a stack tray and a processing tray.

FIG. 15A shows a state in which the first sheet is conveyed into the processing tray; and FIG. 15B shows a state in which the first sheet is conveyed into the processing tray further.

FIG. 16A shows a state in which the second sheet has been delivered to the sheet processing apparatus; and FIG. 16B shows a state in which the first sheet abuts a stopper.

FIG. 18A shows a state in which discharging of the sheet stack from the processing tray to the stack tray has been just started; FIG. 18B shows a state in which sheet stack has been halfway discharged from the processing tray to the stack tray.

FIG. 20A shows a state in which the first sheet has been delivered to the sheet processing apparatus; and FIG. 20B shows a state in which the first sheet has been received up to a switchback point.

FIG. 21A shows a state in which the trailing edge of the first sheet is received by a trailing edge receiving portion; and FIG. 21B shows a state in which the first sheet is pressed against a lower conveyance guide plate by a trailing edge retention.

FIG. 22A shows a state in which the second sheet has been conveyed into the sheet processing apparatus; and FIG. 22B shows a state in which the second sheet has been conveyed into the sheet processing apparatus further.

FIG. 23A shows a state in which the second sheet has been received up to the switch-back point; FIG. 23B shows a state in which the trailing edge of the second sheet is received by the trailing edge receiving portion.

FIG. 25A shows a state in which the third sheet has been delivered; and FIG. 25B shows a state in which the third sheet has been fully delivered.

FIG. 26A shows a state in which discharge of the sheet stack from the processing tray to the stack tray has been just started; and FIG. 26B shows a state in which the sheet stack is conveyed in the discharging direction.

FIG. 27A shows a state in which the sheet stack has been discharged from the processing tray to the stack tray; and FIG. 27B shows a state in which the buffer sheets are conveyed into the processing tray.

FIG. 28A shows a state in which the buffer sheets are conveyed into the processing tray; FIG. 28B shows a state in which the buffer sheets are conveyed into the processing tray further.

DETAILED DESCRIPTION OF THE PREFERRED EMBODIMENT

In the following, a sheet processing apparatus according to an embodiment of the present invention and a copying machine as an example of an image forming apparatus equipped with the sheet processing apparatus will be described with reference to the accompanying drawings. In connection with this, it should be understood that the image forming apparatus includes a copying machine, a facsimile machine, a printer or a multi function machine having combined functions of those machines, and therefore the image forming apparatus to which the sheet processing apparatus according to the present invention is to be equipped is not limited to a copying machine.

In addition, dimensions, numerical values, materials, shapes and relative positions that will be described in connection with the constituent parts of the embodiment will not be intended to limit the scope of the present invention unless otherwise specified.

The following description of the embodiment will be made with reference to a case in which the sheet processing apparatus is an optional apparatus that is adapted to be detachably attached to the main body of an image forming apparatus, as an individual apparatus. However, it is apparent that the sheet processing apparatus according to the present invention may be applied to the case in which the apparatus is integrally provided in an image forming apparatus. Even in that case, the functions of the apparatus are not different from those of the sheet processing apparatus that will be described in the following, and therefore the description of such an apparatus will be omitted.

Figure 1:
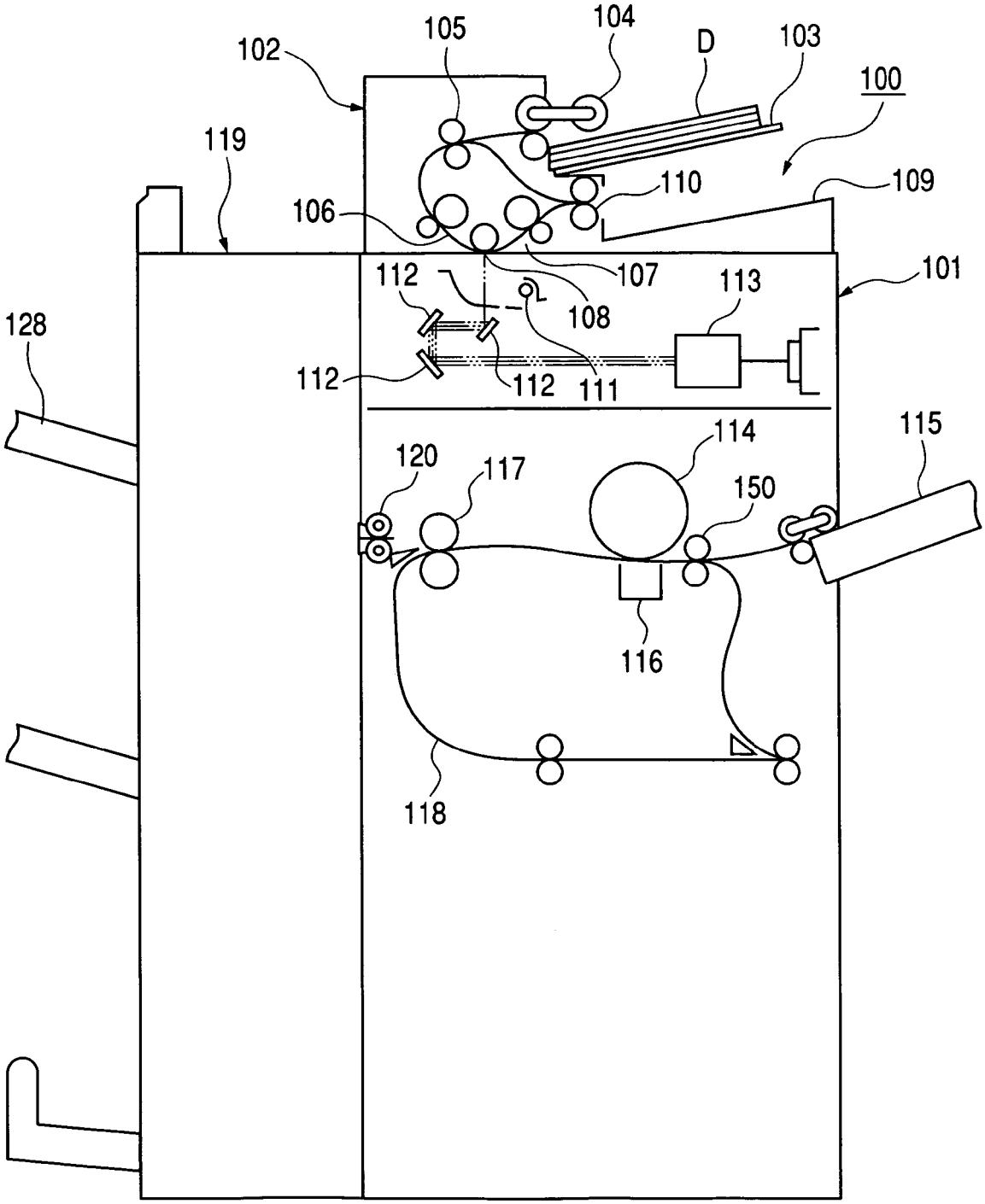
FIG. 1 is a schematic front cross sectional view showing an image forming apparatus in the form of a copying machine with a sheet processing apparatus according to an embodiment of the present invention equipped on the main body of the apparatus.

FIG. 1 is a schematic cross sectional view showing a copying machine to which a sheet processing apparatus is attached. Specifically, the sheet processing apparatus is a finisher, for example.

(Image Forming Apparatus)

The copying machine 100 is composed of a main body of the apparatus 101 and a sheet processing apparatus 119. On the top of the main body 101, there is provided an original feeding apparatus 102. Sheets D are set by a user on an original placement portion 103 and fed to a registration roller pair 105 separately one by one by means of a feeding portion 104. The original D is then stopped temporarily by the registration roller pair 105 and caused to form a loop so that skewed feeding is corrected. After that, the original D is made to pass through a reading position 108 via an introducing path 106, so that the image formed on the surface of the original D is read. Having passed through the reading position 108, the original D is made to pass through a discharge path 107 so as to be discharged onto a discharge tray 109.

In the case that both the front and back sides of the original are to be read, one of the side of the original D is read first when the original passes through the reading position 108 in the above-described manner. After that, the original is made to pass the discharge path 107 and switched back by a reversing roller pair 110 so as to be conveyed to the registration roller pair 105 again under the state in which the sides of the original have been reversed.

Thus, skewed feeding of the original D is corrected by the registration roller pair in the same manner as in the case that the image on one of the sides was read, and then the original is made to pass through the introducing path 106 and the reading position 108, at which the image on the other side of the original D is read. After that, the original D is made to pass through the discharge path 107 so as to be discharged onto the discharge tray 109.

The image on the original D that passes through the reading position 108 is irradiated with light emitted from an illumination system 111. The light reflected from the original is directed by a mirror 112 to an optical element 113 (composed of a CCD or other element), at which image data is generated. A laser beam based on this image data is irradiated onto image forming means in the form of, for example, a photosensitive drum 114, so that a latent image is formed thereon. Alternatively, the apparatus may be constructed in such a way that the reflected light is guided onto the photosensitive drum 114 directly by the mirror 112 to form a latent image, although such a structure is not shown in the drawings.

Toner supplied from a toner supplying apparatus (not shown) is applied to the latent image formed on the photosensitive drum 114, so that a toner image is formed. A cassette 115 stores recording mediums in the form of paper sheets or plastic films etc. A sheet is sent out from the cassette 115 in response to a recording signal and entered into between the photosensitive drum 114 and a transferring device 116 by a registration roller pair 150 at appropriate timing. The toner image on the photosensitive drum 114 is transferred by the transferring device 116 onto the sheet. As the sheet on which the toner image has been transferred passes through a fixing apparatus 117, the toner image is fixed by heat and pressure applied by the fixing apparatus 117.

In the case that images are to be formed on both sides of the recording medium, the sheet on one side of which the image has been fixed by the fixing apparatus 117 is made to pass through a double-side path 118 provided in the downstream of the fixing apparatus 117 and delivered into between the photosensitive drum 114 and the transferring device 116. Thus, an toner image is transferred also on the back side of the sheet. The toner image is fixed in the fixing apparatus 117, and the sheet is discharged to the exterior (i.e. to the finisher 119).

Figure 2:
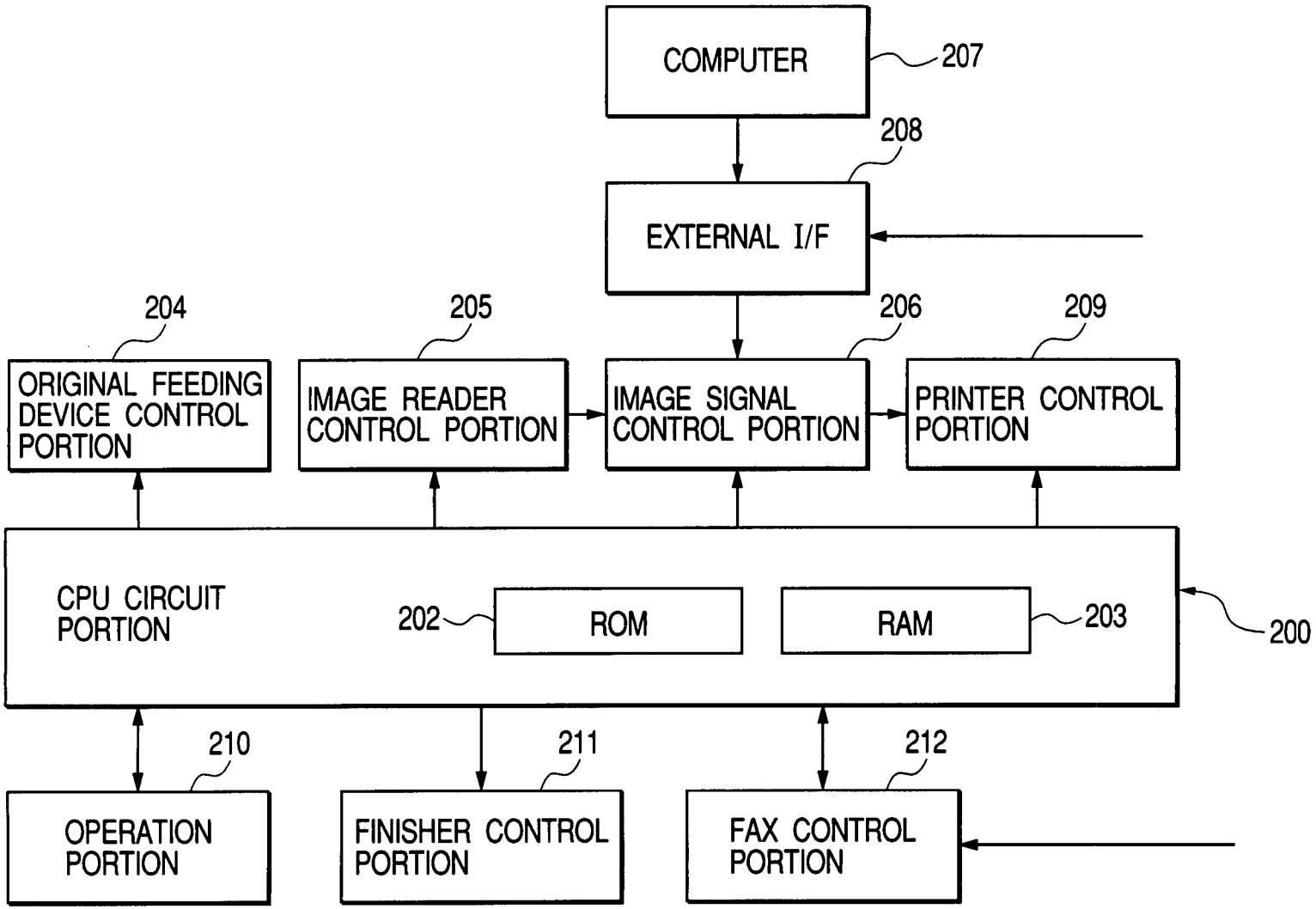
FIG. 2 is a block diagram of the copying machine shown in FIG. 1.

FIG. 2 is a block diagram showing an overall control system of the copying machine. The copying machine 100 as a whole is adapted to be controlled by a CPU circuit portion 200. In the CPU circuit portion 200, there is provided a ROM 202 in which sequences or control processes of various portions are stored and a RAM 203 in which various information is to be stored temporarily as the need arises. An original feeding device control portion 204 is adapted to control the original feeding operation of the original feeding apparatus 102. The image reader control portion 205 is adapted to control the illumination system 111 etc. to control the original reading operation. An image signal control portion 206 is adapted to receive read information from the image reader control portion 205 or image information sent from an external computer 207 via an external I/F 208 to process the information and to send a processed signal to a printer control portion 209. The printer control portion 209 is adapted to control the photosensitive drum 114 etc. based on the processed image signal from the image signal control portion 206 so as to have an image formed on a sheet.

An operation portion 210 is adapted in such a way that sheet size information and information on which processing (for example, stapling) is to be performed on sheets can be entered when a user uses the copying machine. In addition, the operation portion 210 is adapted to display information on the operating state or other information on the main body 101 of the copying machine or the finisher 119 as a sheet post-processing apparatus. A finisher control portion 211 is adapted to control the internal operation of the finisher 119 as a sheet post-processing apparatus. A fax control portion 212 is adapted to control the copying machine to enable the copying machine to function as a facsimile machine so that it can transmit/receive a signal to/from another facsimile machine.

(Sheet Processing Apparatus)

Figure 3:
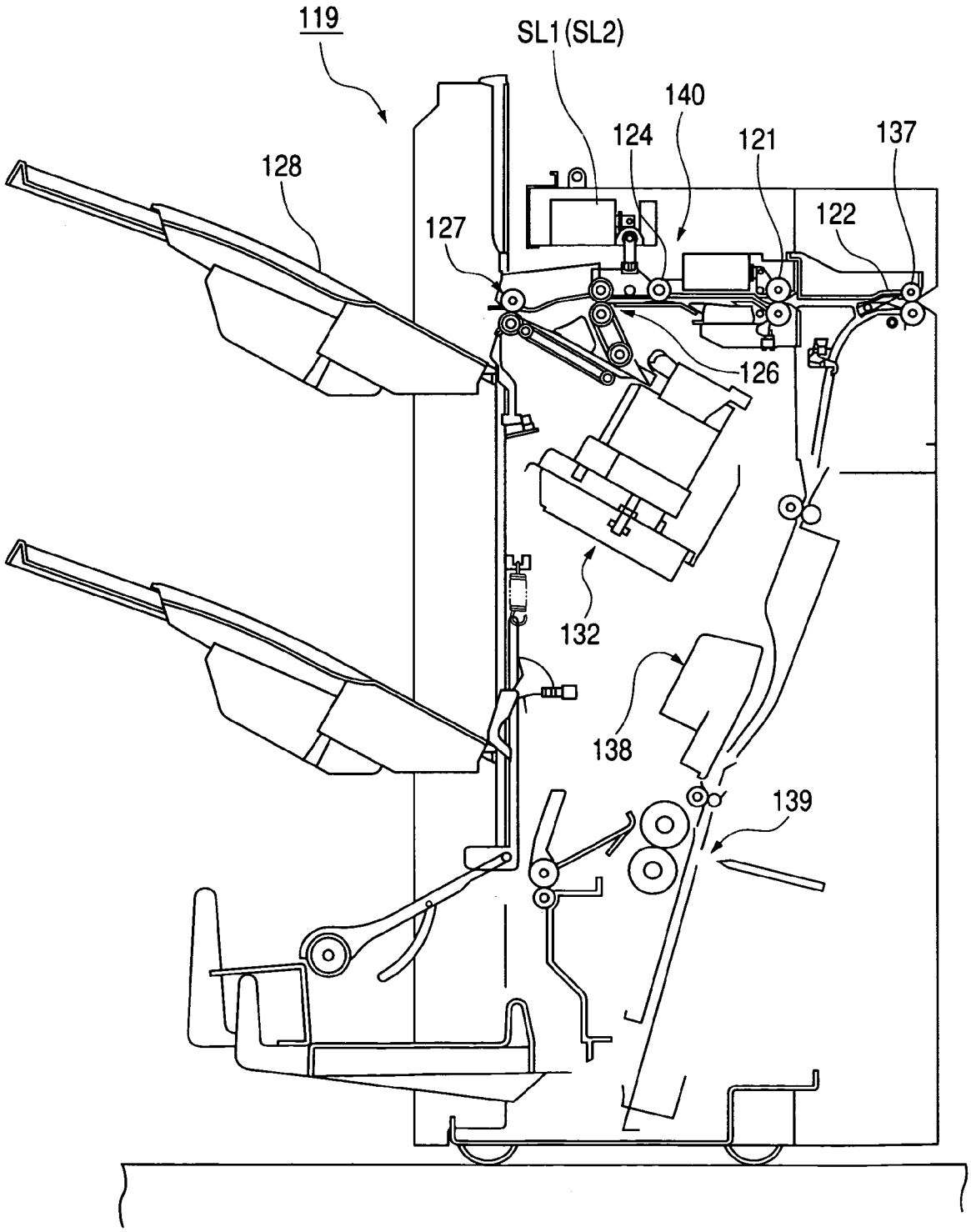
FIG. 3 is a schematic front cross sectional view showing the sheet processing apparatus according to the embodiment of the present invention.
Figure 4:
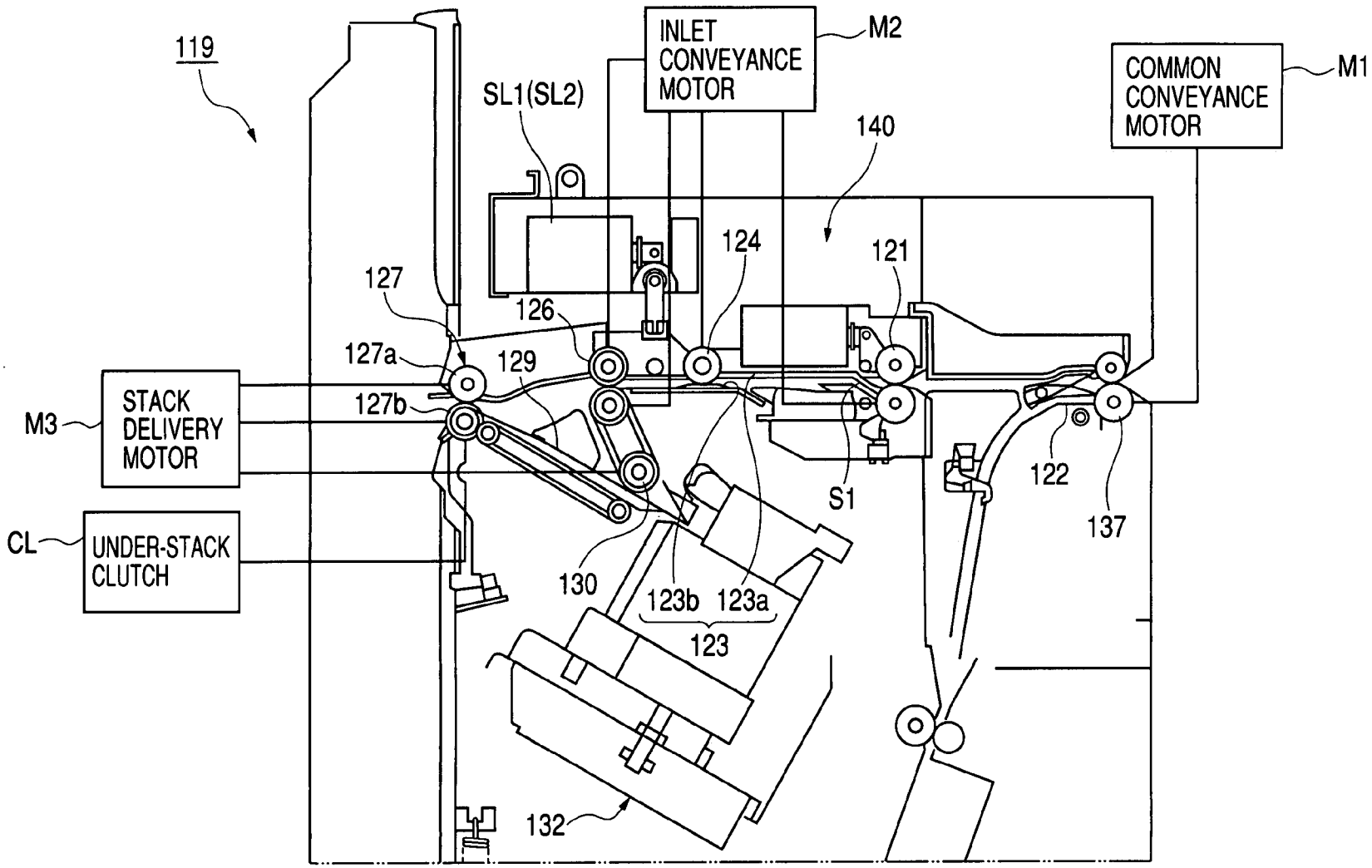
FIG. 4 is a schematic front cross sectional view showing various driving systems in the sheet processing apparatus according to the embodiment of the present invention.
Figure 9:
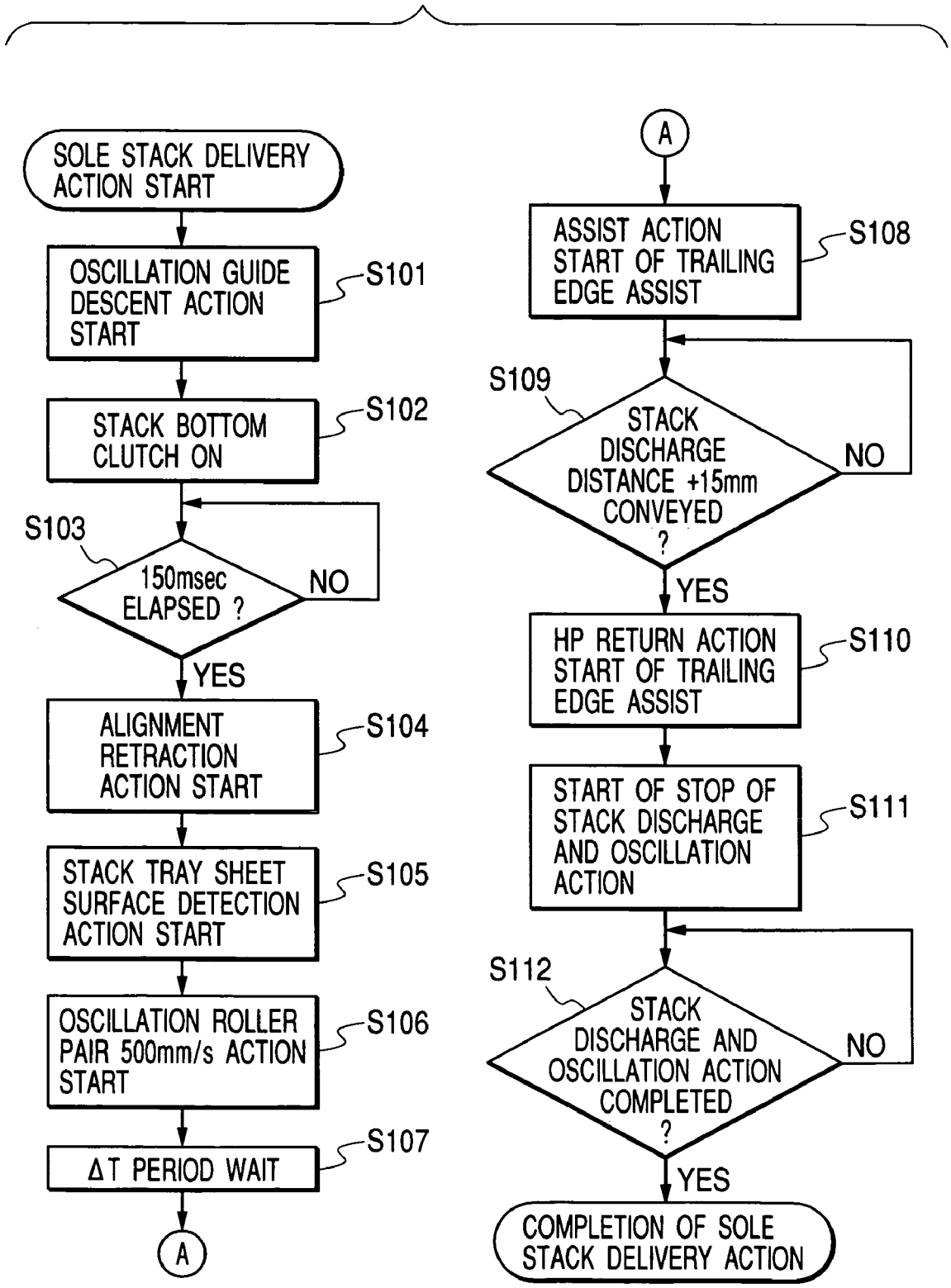
FIG. 9 is a flow chart illustrating a sheet stack discharge operation of the sheet processing apparatus shown in FIG. 3.
Figure 10:
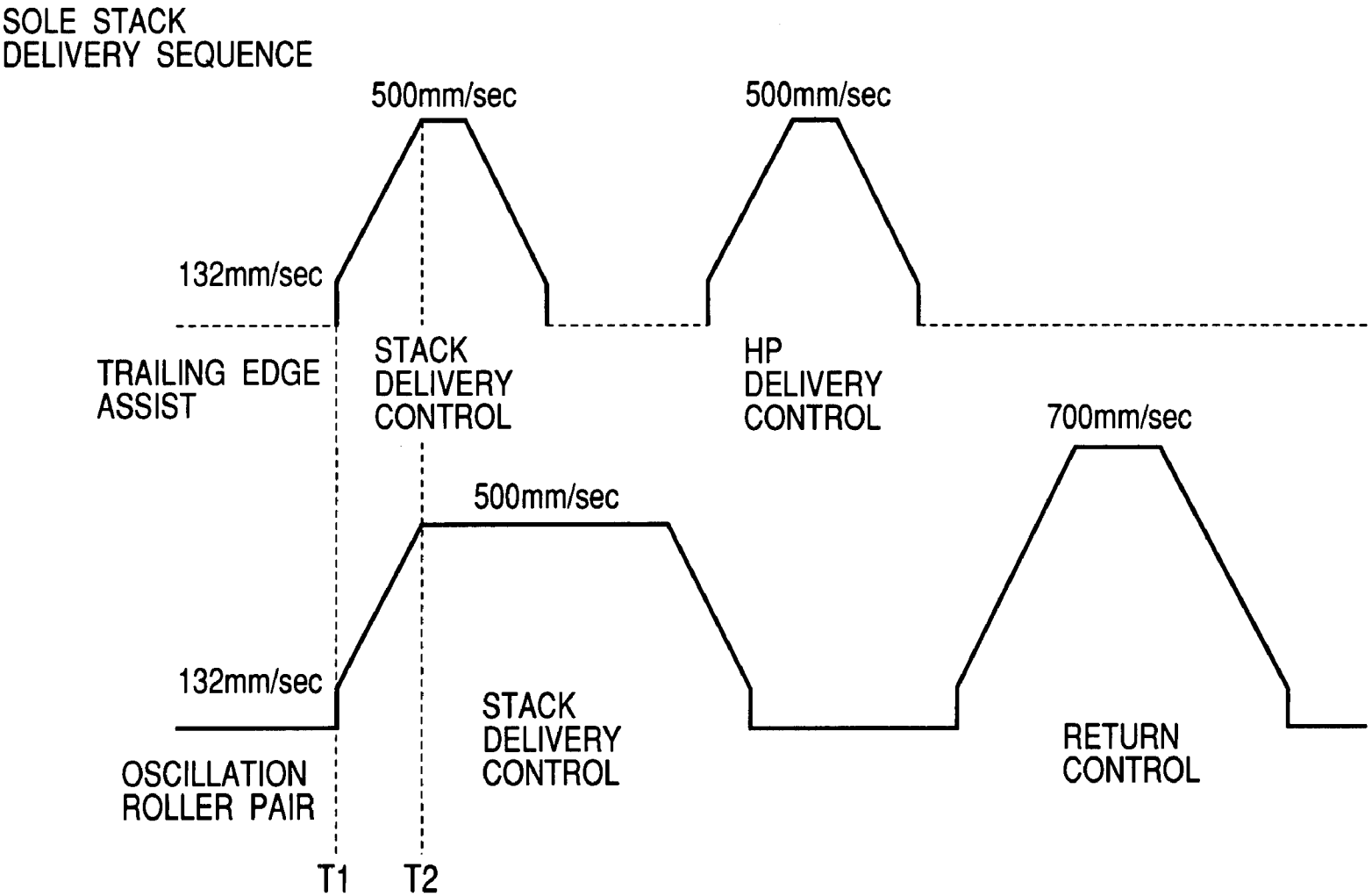
FIG. 10 is a chart for illustrating operation timing of the trailing edge assist and the oscillation roller pair.
Figure 11:
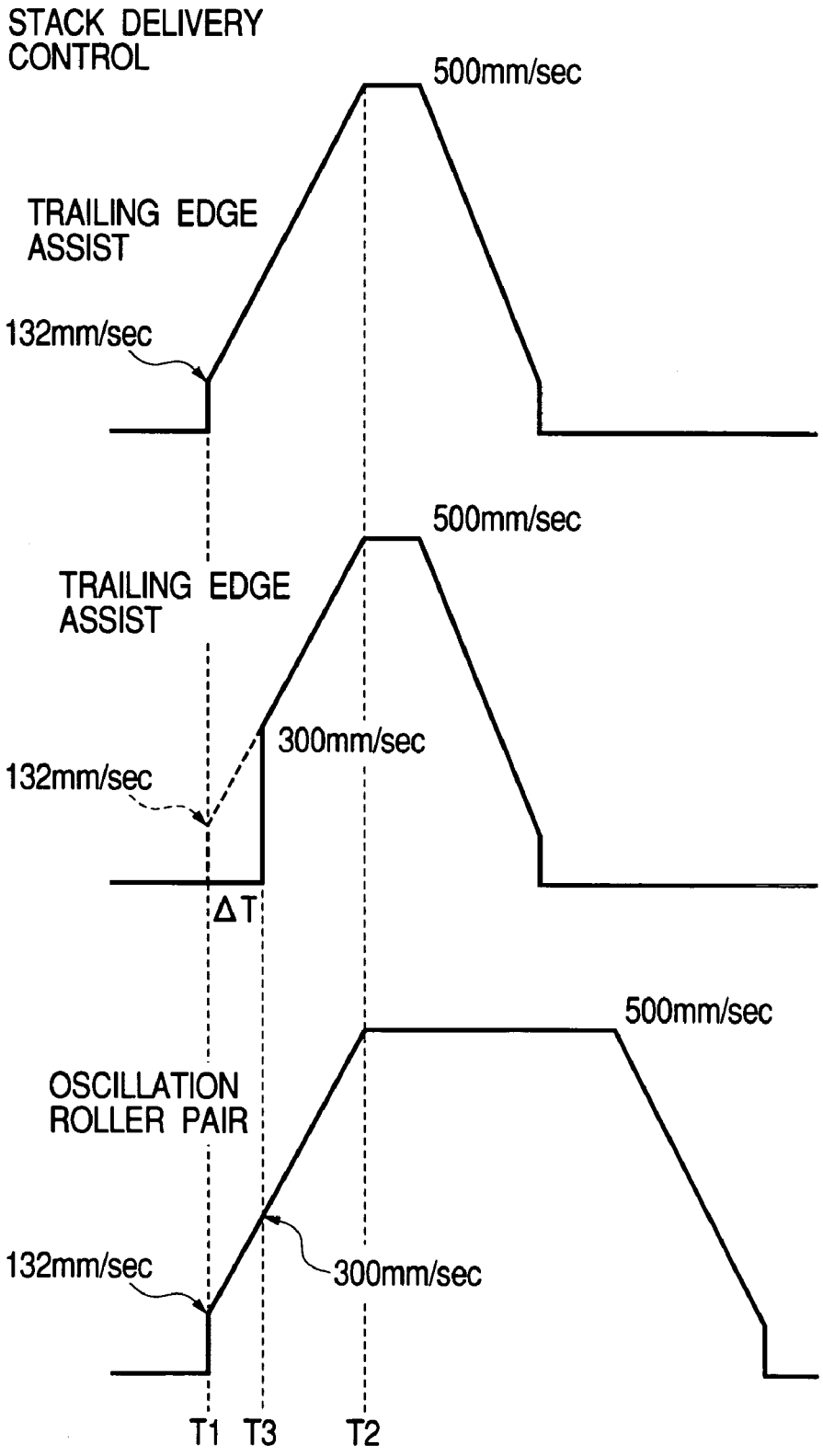
FIG. 11 is a chart for illustrating operation timing of the trailing edge assist and an oscillation roller pair.
Figure 12:
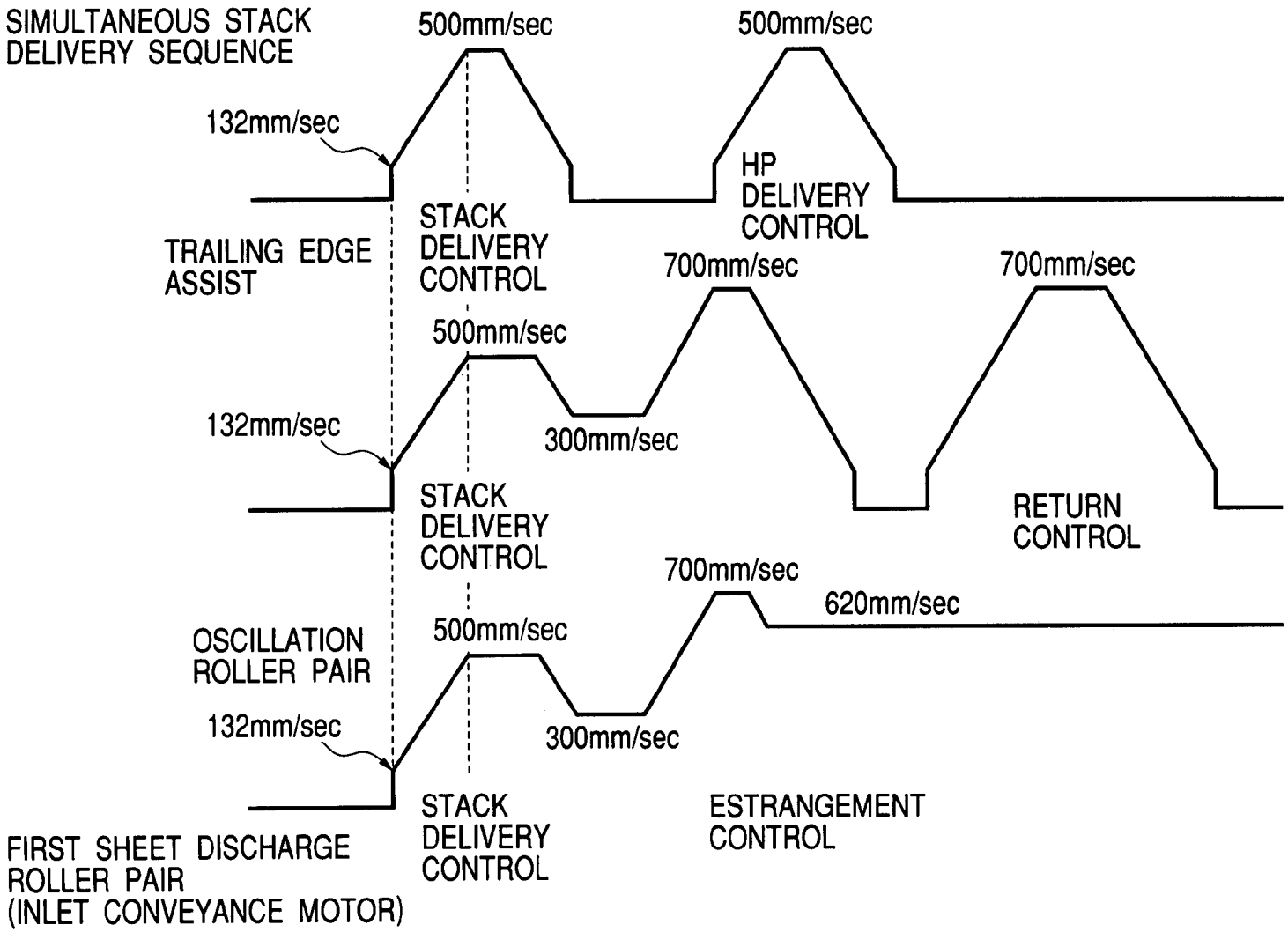
FIG. 12 is a chart for illustrating operation timing of the trailing edge assist, the oscillation roller pair and a first sheet discharge roller pair.

FIG. 3 is a vertical cross sectional view of the sheet processing apparatus. FIG. 4 is a vertical cross sectional view in which a driving system is illustrated. FIG. 2 is a block diagram of the control system of the sheet processing apparatus. FIG. 9 is a flow chart for illustrating the operation of the sheet processing apparatus. FIGS. 10 to 12 are diagrams showing the moving speed of a trailing edge assist 134 and the sheet conveying speed of an oscillation roller pair 127 in relation to the lapsed time. FIG. 10 shows a sole stack delivery sequence in which a sheet stack is delivered by the trailing edge assist 134 and the oscillation roller pair 127. FIG. 11 shows a stack delivery control under the condition in which the initial speed of the trailing edge assist 134 is different from the initial speed of the oscillation roller pair 127. FIG. 12 shows a simultaneous stack delivery sequence in which a sheet stack and buffer sheets stored in a buffer unit 140 are simultaneously conveyed by the trailing edge assist 134, the oscillation roller pair 127 and a first conveying roller pair.

The sheet processing apparatus 119 has a function of binding a sheet stack. The sheet processing unit 119 is provided with stapler units 132 for stapling a sheet stack at positions near the edge of the sheet stack, a stapler 138 for stapling the sheet stack at a central position and a folding unit 139 for folding the sheet stack stapled by the stapler 138 at the stapled position to make the sheet stack into a book-like form.

The sheet processing apparatus 119 according to the embodiment is provided with a buffer unit 140 for storing (i.e. buffering) a plurality of sheets stacked in a straight (or flat) state during the operation of the stapler units 132.

Figure 31:
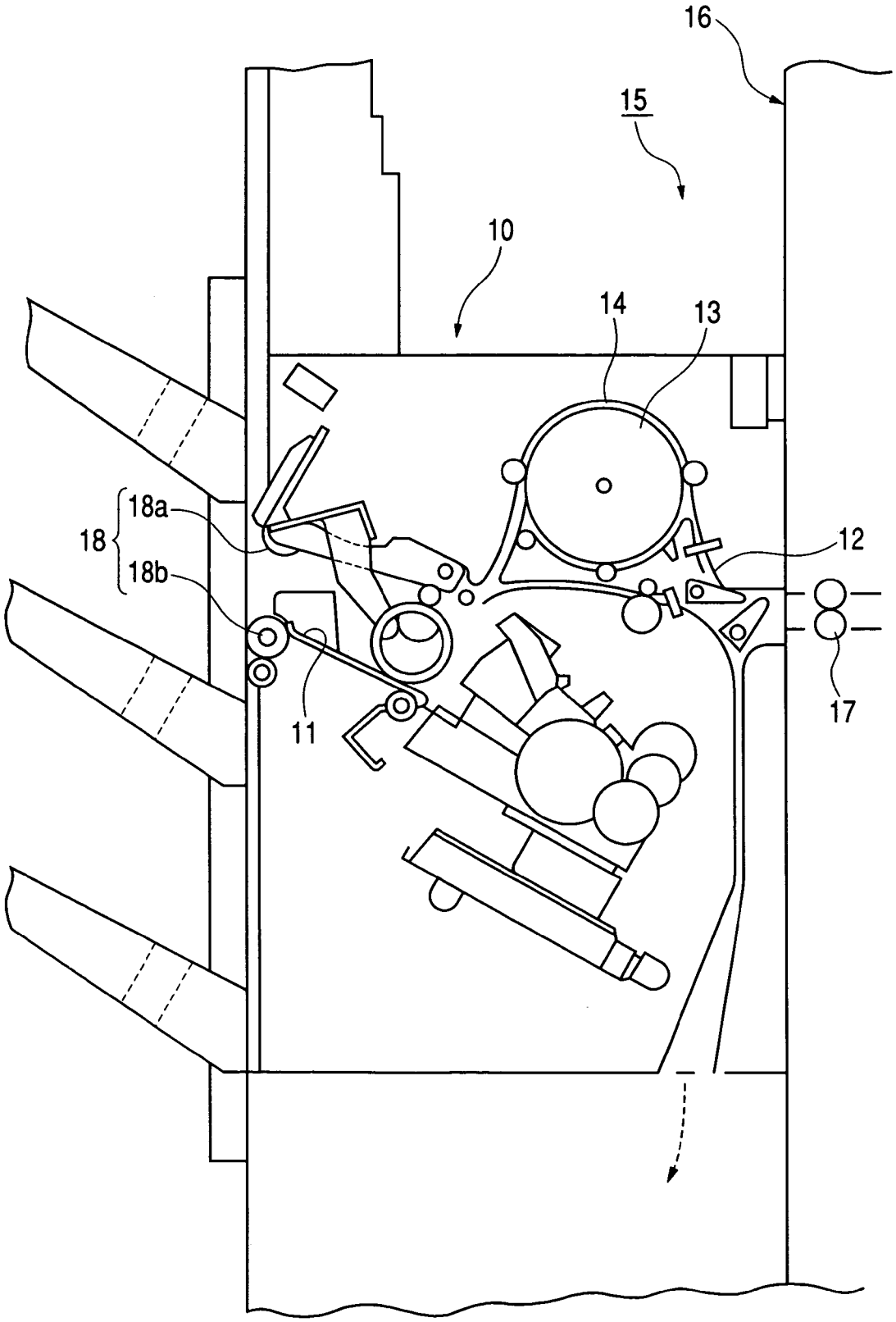
FIG. 31 is a front cross sectional view showing a conventional sheet processing apparatus.

Since the buffer unit 140 is adapted to store a plurality of sheets stacked in a straight state, the buffer unit 140 can be formed in a flat shape unlike conventional structures such as the structure including the buffer roller 13 shown in FIG. 31. Consequently, it is possible to make the sheet processing apparatus compact and lightweight. In addition, since the buffer unit 140 can store the sheets in a straight state and the sheets are not curled unlike in the case with the buffer roller, handling of the sheets is easy, and so the sheet processing time of the sheet processing apparatus can be reduced.

Figure 8:
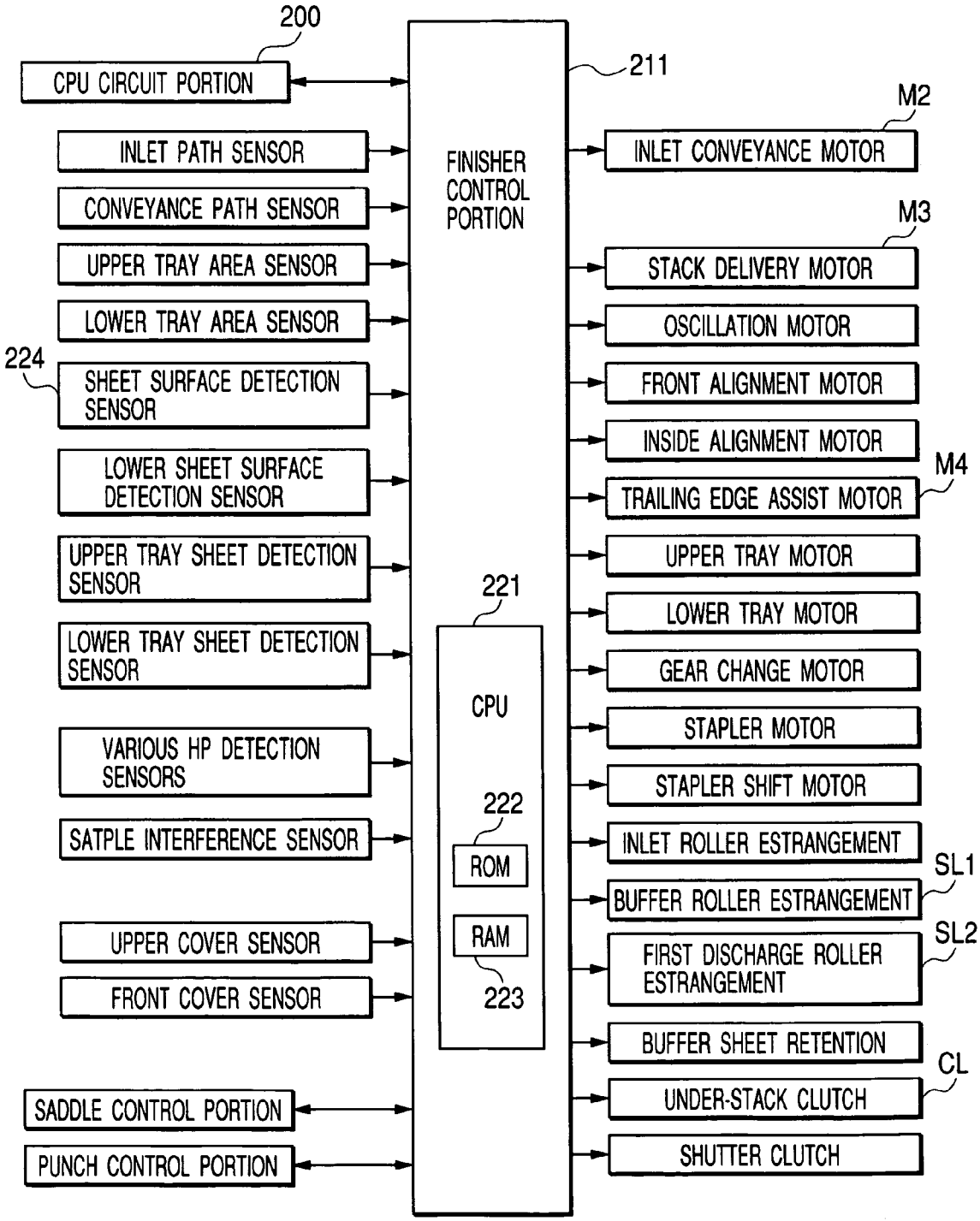
FIG. 8 is a block diagram of a control system of the sheet processing apparatus shown in FIG. 3.

The sheet processing apparatus 119 is controlled by a finisher control portion 211 shown in FIGS. 2 and 8. In the CPU 221 of the finisher control portion 211, there is provided a ROM 222 in which a control sequence of the sheet processing apparatus 119 that is executed based on a command from the CPU circuit portion 200 of the main body of the copying machine is stored and a RAM 223 in which information required for controlling the sheet processing apparatus as occasion demands is to be stored. In addition, the finisher control portion 211 is connected with a sheet surface detection sensor 224 that operates based on the operation of a sheet surface detection lever 133, which will be described later. The CPU 221 is adapted to control up and down movement of a stack tray 128 based on a sheet detection signal of the sheet detection sensor 224. The finisher control portion 211 is adapted to control, based on the aforementioned sequence, the operation of an inlet conveyance motor M2 for rotating an inlet roller pair 121, a buffer roller 124 and a first sheet discharge roller pair, the operation of a stack delivery motor M3 for rotating the oscillation roller pair 127 and a return roller 130 and the operation of a under-stack clutch CL for turning on/off (i.e. enabling/disabling) the transmission of rotation from the stack delivery motor M3 to the lower roller 127*b*.

Incidentally, the CPU control circuit portion 200 and the finisher control portion 211 shown in FIG. 2 may be integrated.

Since the lower roller 127*b* and the return roller 130 are rotated commonly by the stock delivery motor M3, when a sheet or a stack of sheets are conveyed by the lower roller 127*b* and the return roller 130, the sheet or the stack of sheets can be wrinkled or broken if slippage occurs or a difference in the sheet conveying speed is generated between both the rollers. The under-stack clutch CL shown in FIG. 4 is provided in order to absorb such a speed difference.

(Description of Sheet Stack Stapling and Discharging Operation)

When a sheet stapling operation is selected by a user through the display on the operation portion 210 (shown in FIG. 2) of the copying machine 100, the CPU circuit portion 200 controls each portion in the main body of the apparatus to start the copying operation of the copying machine 100 and sends a sheet stapling operation signal to the finisher control portion 211.

The description of the operation with reference to FIGS. 13A to 19 will be directed to a case in which it is determined by the CPU circuit portion 200, based on sheet size information entered into the operation portion 210 by the user, that the sheet is long (for example, in the case of the A3 size sheet) or to a case in which it is determined based on sheet type information that the sheet is a particular sheet, such as a cardboard, a thin paper sheet, a tab sheet or a color paper sheet, having a property different from a normal sheet. In other words, the description of the operation in connection with FIGS. 13A to 19 is directed to the case in which the operation of stacking buffer sheets (which will be described later) on a processing tray 129 is started after a sheet stack is discharged onto the stack tray 128, namely to the case in which it is not necessary to store sheets during the sheet processing. However, it is apparent that the operation that will be described in the following may also be performed irrespective of the sheet length and irrespective of whether the sheet is a particular sheet or not.

The finisher control portion 211 activates the inlet conveyance motor M2 and the stack delivery motor M3 based on the sheet stapling operation signal. The finisher control portion 211 also activates a buffer roller separating plunger SL1 (shown in FIG. 4) to detach the buffer roller 124 from a lower conveyance guide plate 123*b* and activates a plunger that is not shown in the drawing to keep the upper roller 127*a* of the oscillation roller pair 127 away from the lower roller 127*b*. Activation and stopping of the inlet conveyance motor M2 and the stack delivery motor M3 may be controlled step by step in accordance with movement of sheets.

The first sheet delivered from the discharge roller pair 120 of the main body 101 of the copying machine 100 (shown in FIG. 1) is conveyed by a receiving roller pair 137 and guided by a flapper 122, both of which are shown in FIGS. 3 and 4, so as to be delivered to the inlet roller pair 121. The receiving roller pair 137 is adapted to be rotated by a common conveyance motor M1 that rotates the aforementioned discharge roller pair 120.

Figure 13A:
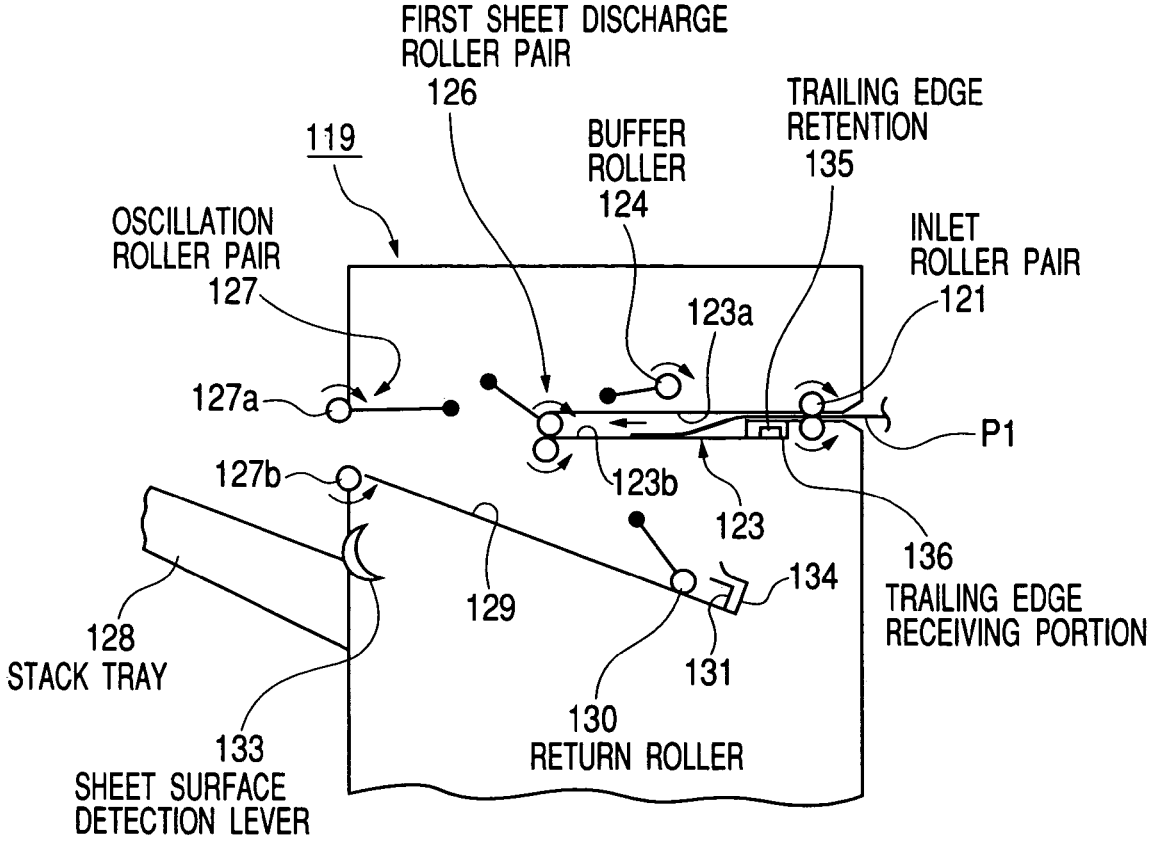
FIGS. 13A and 13B illustrate the operation of the sheet processing apparatus in the case that sheets need not be stored during sheet processing.

As shown in FIG. 13A, the inlet roller pair 121 is rotated by the inlet conveyance motor M2 (shown in FIG. 4) to convey the first sheet P1. The sheet P1 is conveyed to the first discharge roller pair 120 while guided by a guide 123 composed of the upper conveyance guide plate 123*a* and the lower conveyance guide plate 123*b*.

Figure 13B:
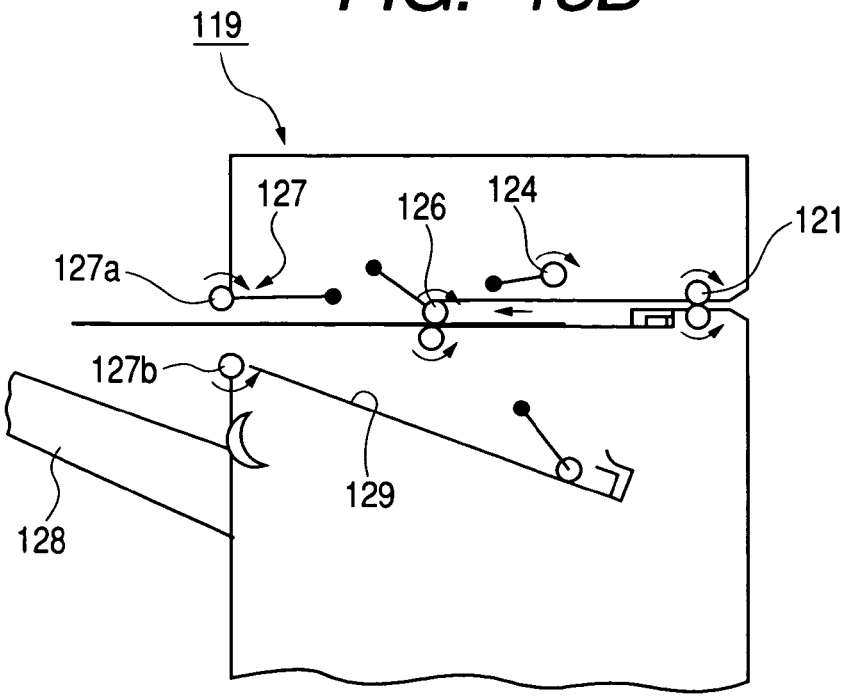
Figure 14A:
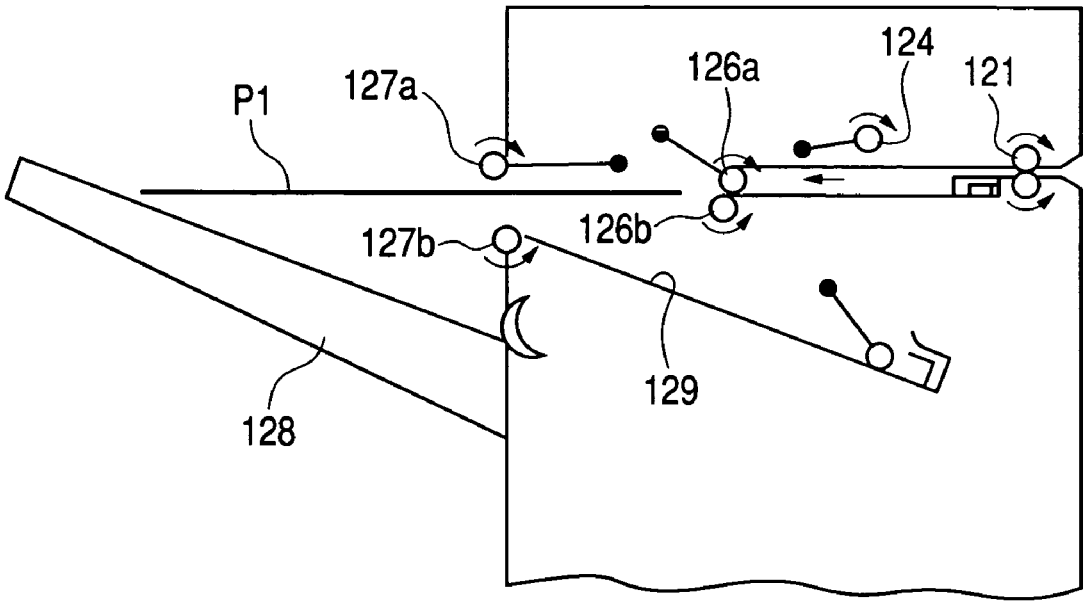
FIGS. 14A and 14B illustrate the operation of the sheet processing apparatus in the case that sheets need not be stored during sheet processing and show states that follow the states shown in FIGS. 13A and 13B.
Figure 14B:
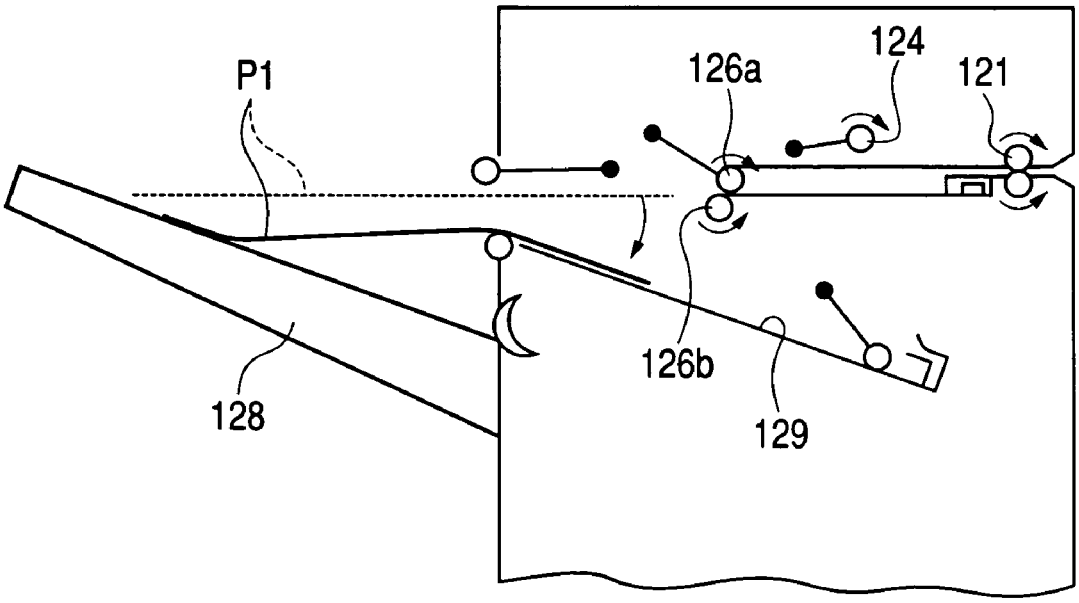
Figure 15A:
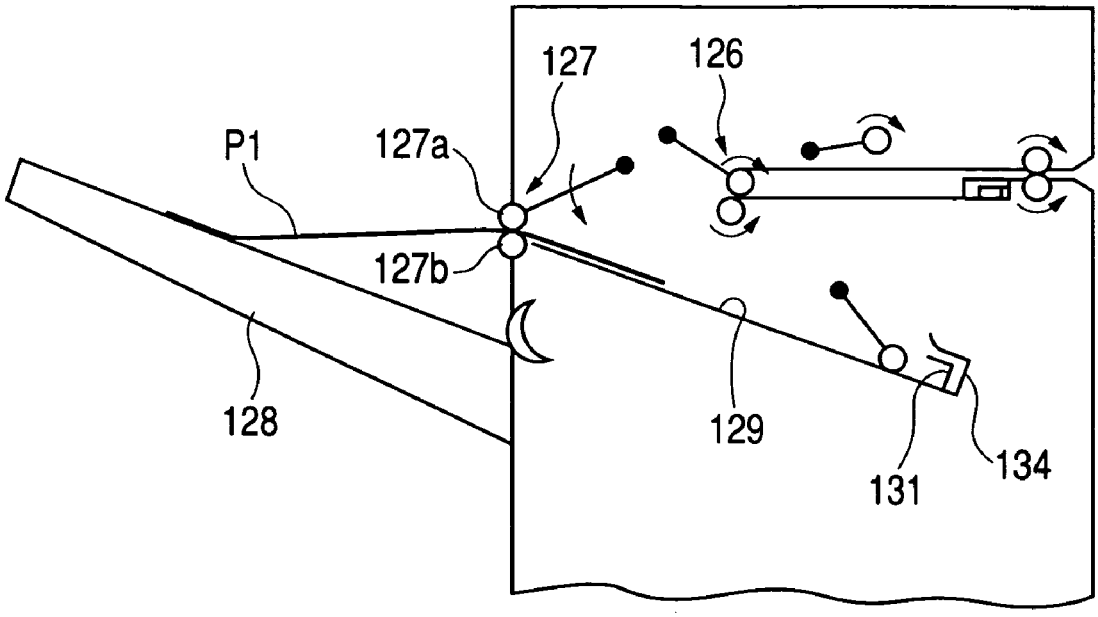
FIGS. 15A and 15B illustrate the operation of the sheet processing apparatus in the case that sheets need not be stored during sheet processing and show states that follow the states shown in FIGS. 14A and 14B.
Figure 15B:
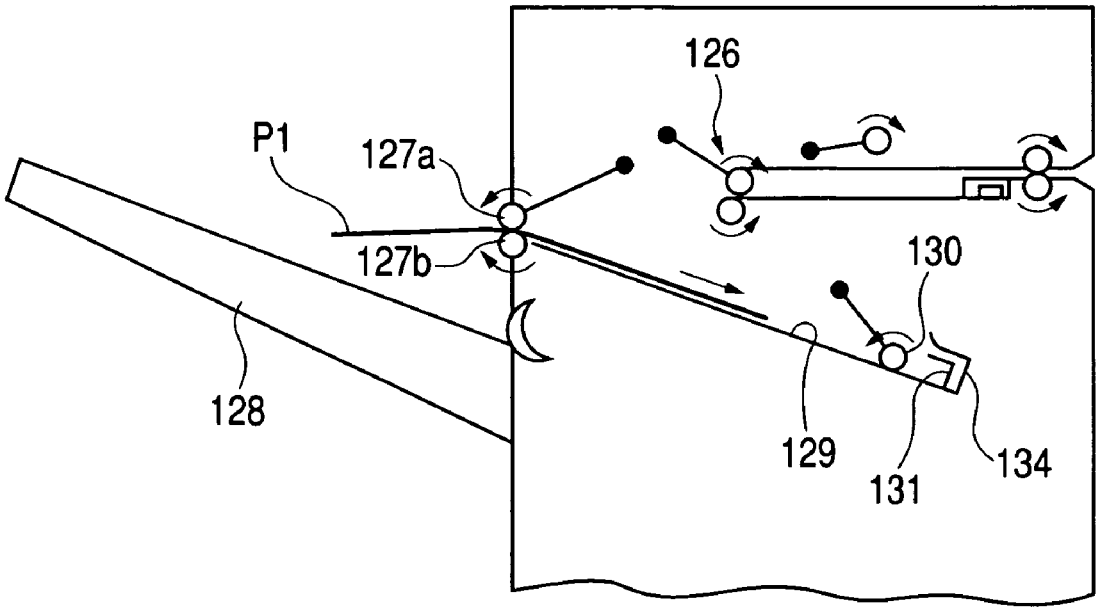

The sheet P1 is conveyed further with the rotation of the first sheet discharge roller pair 126 as shown in FIG. 13B and released in the direction toward the stack tray 128 as shown in FIG. 14A. The sheet P1 falls in such a way as to bridge the stack tray 128 and the processing tray 129. Then, the upper roller 127*a* is lowered by the plunger that is not shown in the drawings so that the sheet P1 is held between the upper roller 127*a* and the lower roller 127*b*.

At that time, the upper roller 127*a* and the lower roller 127*b* have already been rotated in the respective direction indicated by arrows by the stack delivery motor M3 (shown in FIG. 4). In addition, the return roller 130, which can be brought into contact with and detached from the processing tray 129, has also already been rotated by the stack delivery motor M3 (shown in FIG. 4) in the direction shown by an arrow. In connection with this, the transmission of drive to the lower roller 127*b* is made active by the operation of the under-stack clutch CL (shown in FIG. 4) during the processing of the first sheet, but during the processing of the second and succeeding sheets, the transmission is turned off so that the lower roller 127*b* can rotate freely. This is because if the lower roller 127*b* is rotating when the second or succeeding sheet is placed after the first sheet is placed on the processing tray 129, there is the risk that the first sheet can be pushed toward a stopper 131 by the lower roller 127*b* and the first sheet can be wrinkled.

Figure 16A:
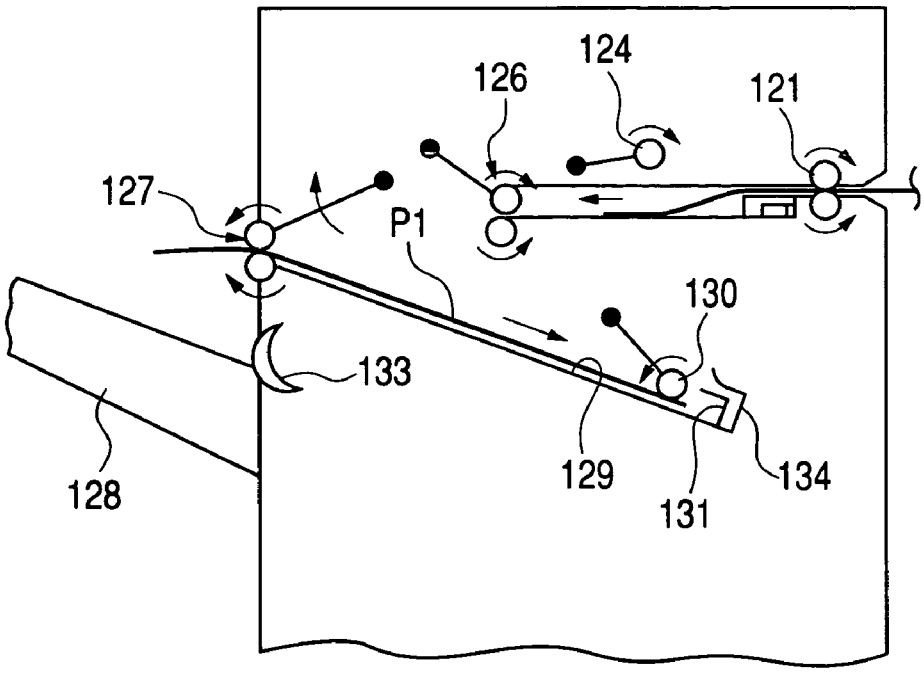
FIGS. 16A and 16B illustrate the operation of the sheet processing apparatus in the case that sheets need not be stored during sheet processing and show states that follow the states shown in FIGS. 15A and 15B.
Figure 16B:
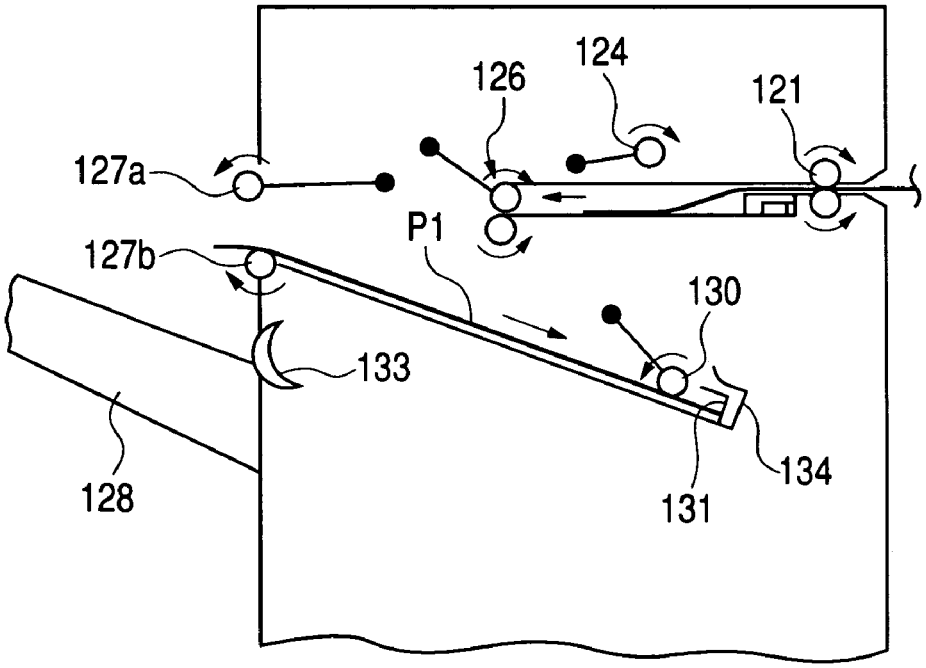

As shown in FIG. 16A, with the rotation of the oscillation roller pair 127 and the return roller 130, the sheet P1 slides down on the processing tray 129 downwardly sloping toward the right, in the direction indicated by an arrow. At that time, the trailing edge assist 134 is at its standby position. The upper roller 127*a* is detached from the sheet P1 before the sheet P1 abuts the stopper 131. The sheet P1 is brought into abutment with the stopper 131 by the return roller 130. After that, sheet width alignment is performed by a pair of alignment plates 144*a* and 144*b* (see FIG. 5).

Figure 17:
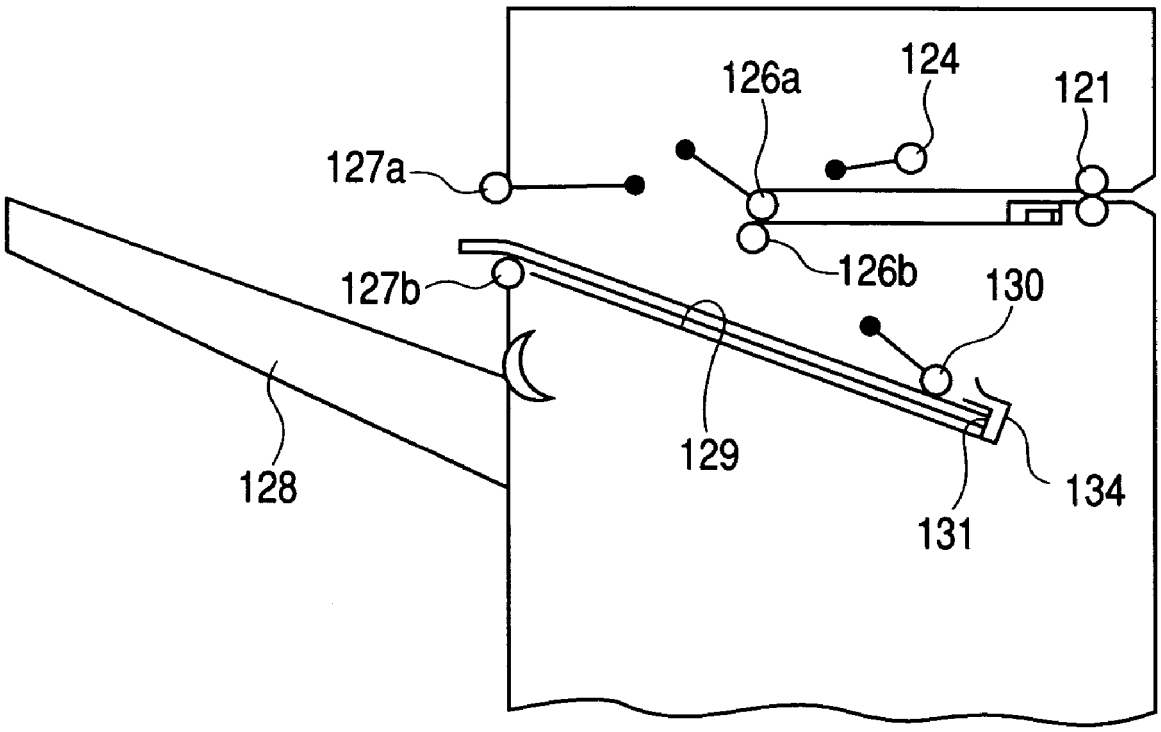
FIG. 17 illustrates the operation of the sheet processing apparatus in the case that sheets need not be stored during sheet processing and shows a state in which three sheets are stacked on the processing tray.

Subsequently, the succeeding sheets are placed on the processing tray 129 in the same manner. As shown in FIG. 17, when a predetermined number of sheets are placed on the processing tray 129, the stack of sheets is stapled by the stapler units 132 shown in FIGS. 3 and 4. Alternatively, punching operation may be performed on the sheet stack by a punching unit (not shown) instead of the stapling operation by the stapler units 132.

In the following, an operation of the sheet processing apparatus is described with reference to the flow chart of FIG. 9.

Figure 18A:
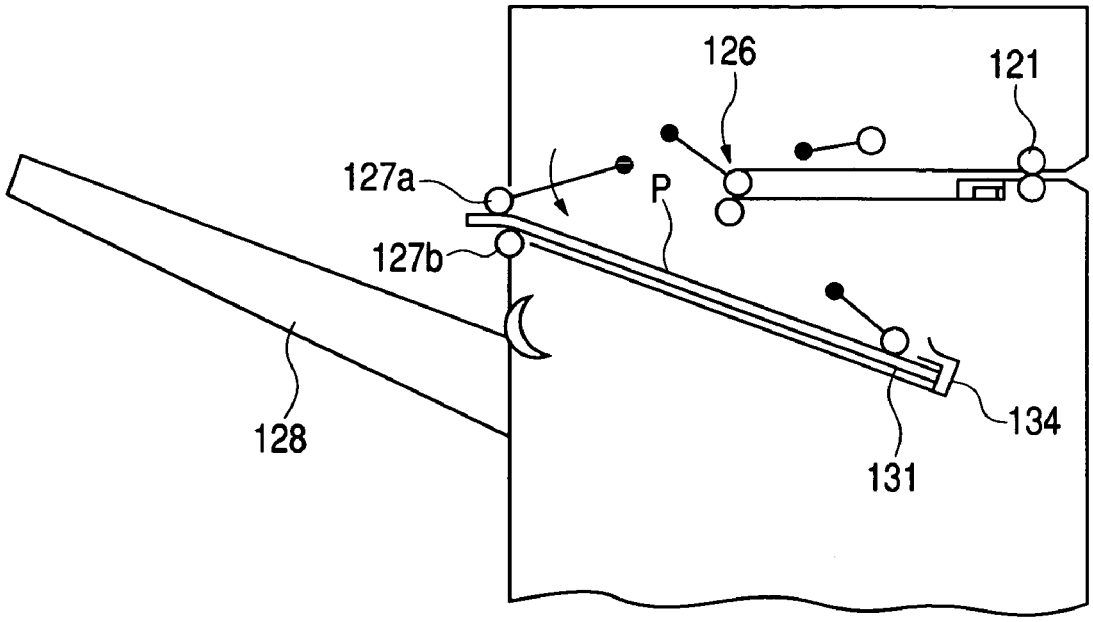
FIGS. 18A and 18B illustrate the operation of the sheet processing apparatus in the case that sheets need not be stored during sheet processing and show states that follow the states shown in FIG. 17.

As shown in FIG. 18A, the upper roller 127*a* is lowered by the plunger that is not shown in the drawings so that the sheet is held between the upper roller 127*a* and the lower roller 127*b* (S101). About 15 milliseconds after (S103) the under-stack clutch CL is turned on (S102), the alignment plates 144 are retracted from the sheet stack (S104). Then, the stack tray 128 is moved to a position at which it can be detected by the sheet surface detection lever 133 and waiting at the position at which it can readily receive the sheet stack to be delivered (S105).

Figure 5:
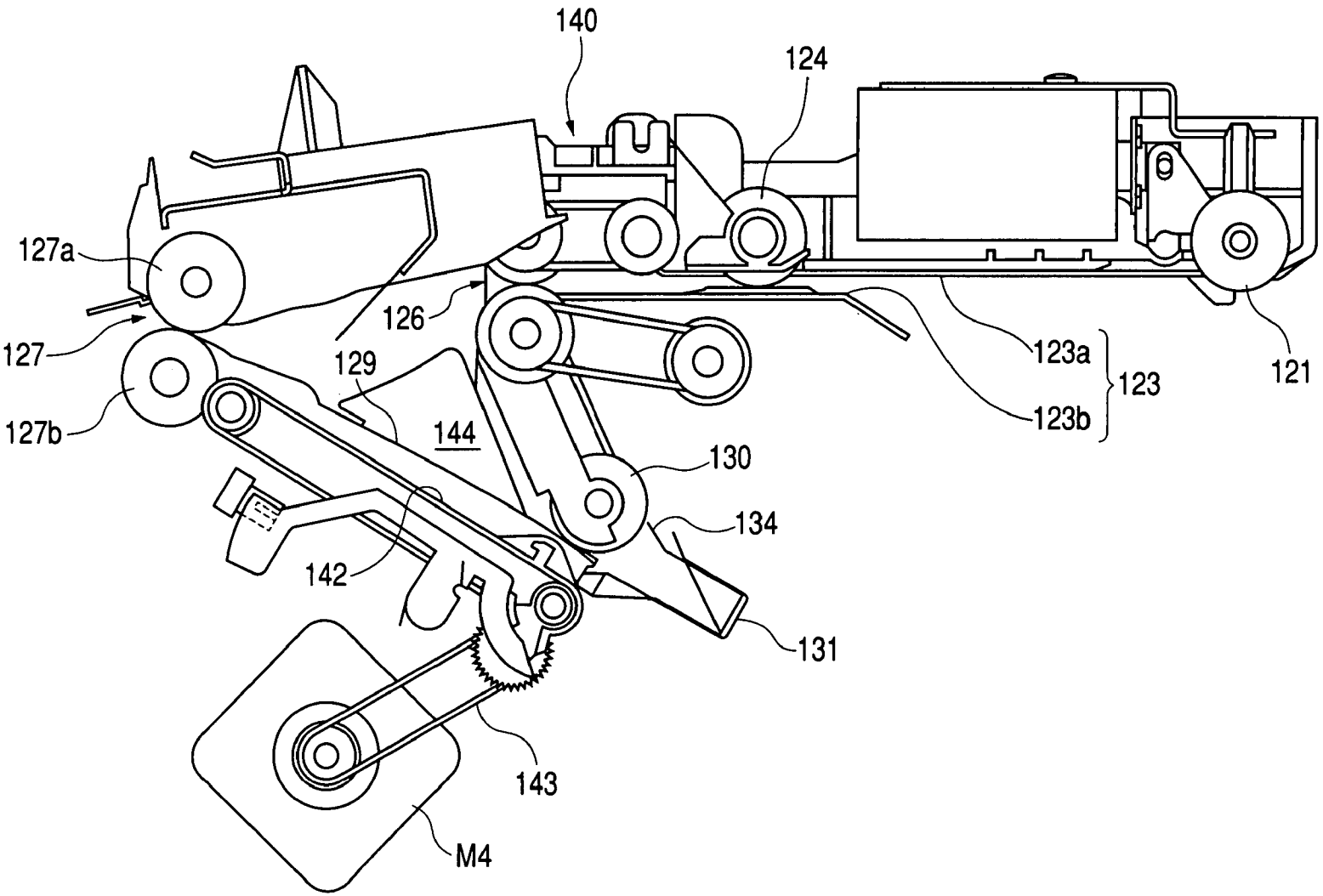
FIG. 5 is an enlarged view showing a principal part of the sheet processing apparatus according to the embodiment of the present invention.
Figure 6:
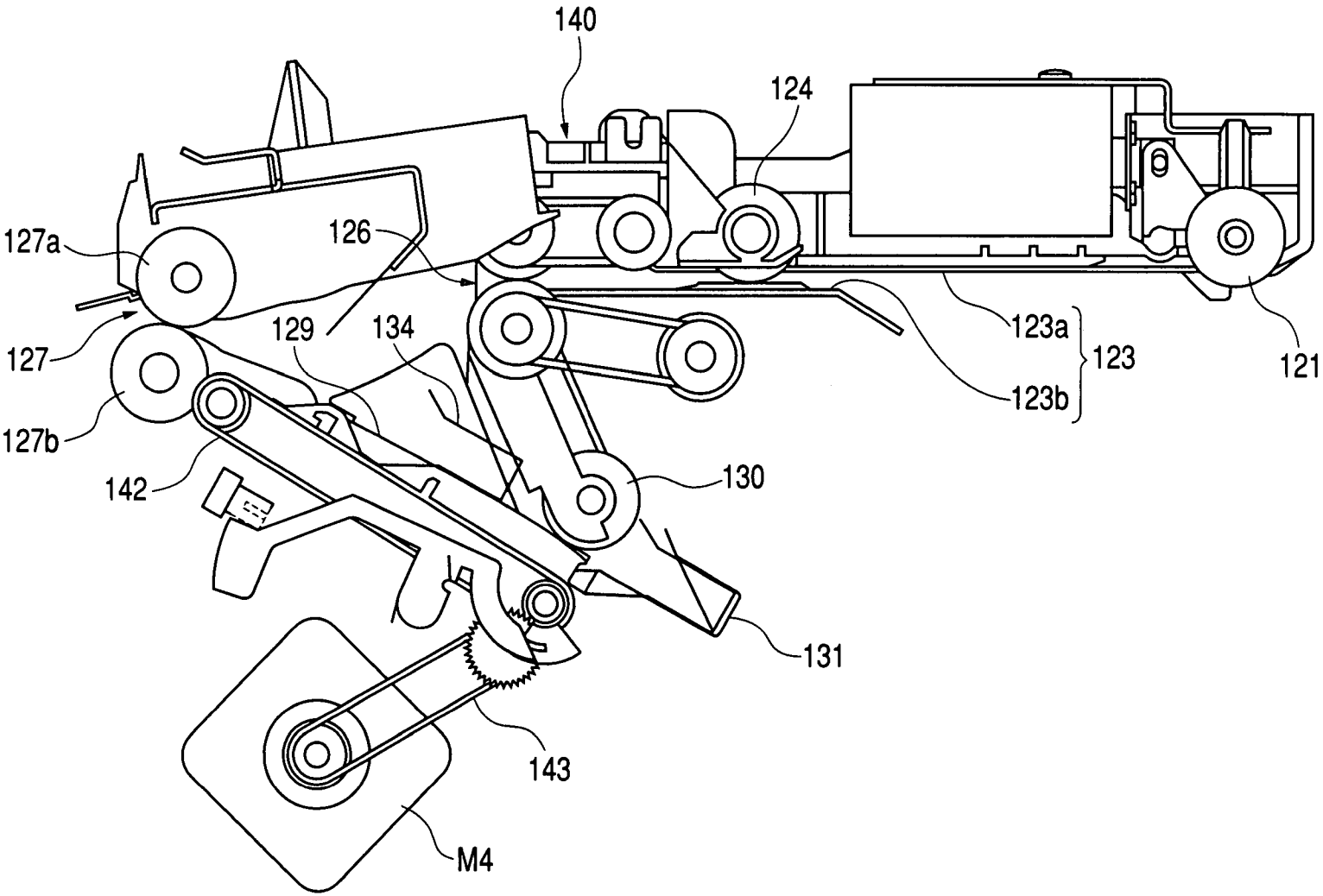
FIG. 6 is an enlarged view similar to FIG. 5 showing a state in which a trailing edge assist has been moved.
Figure 7:
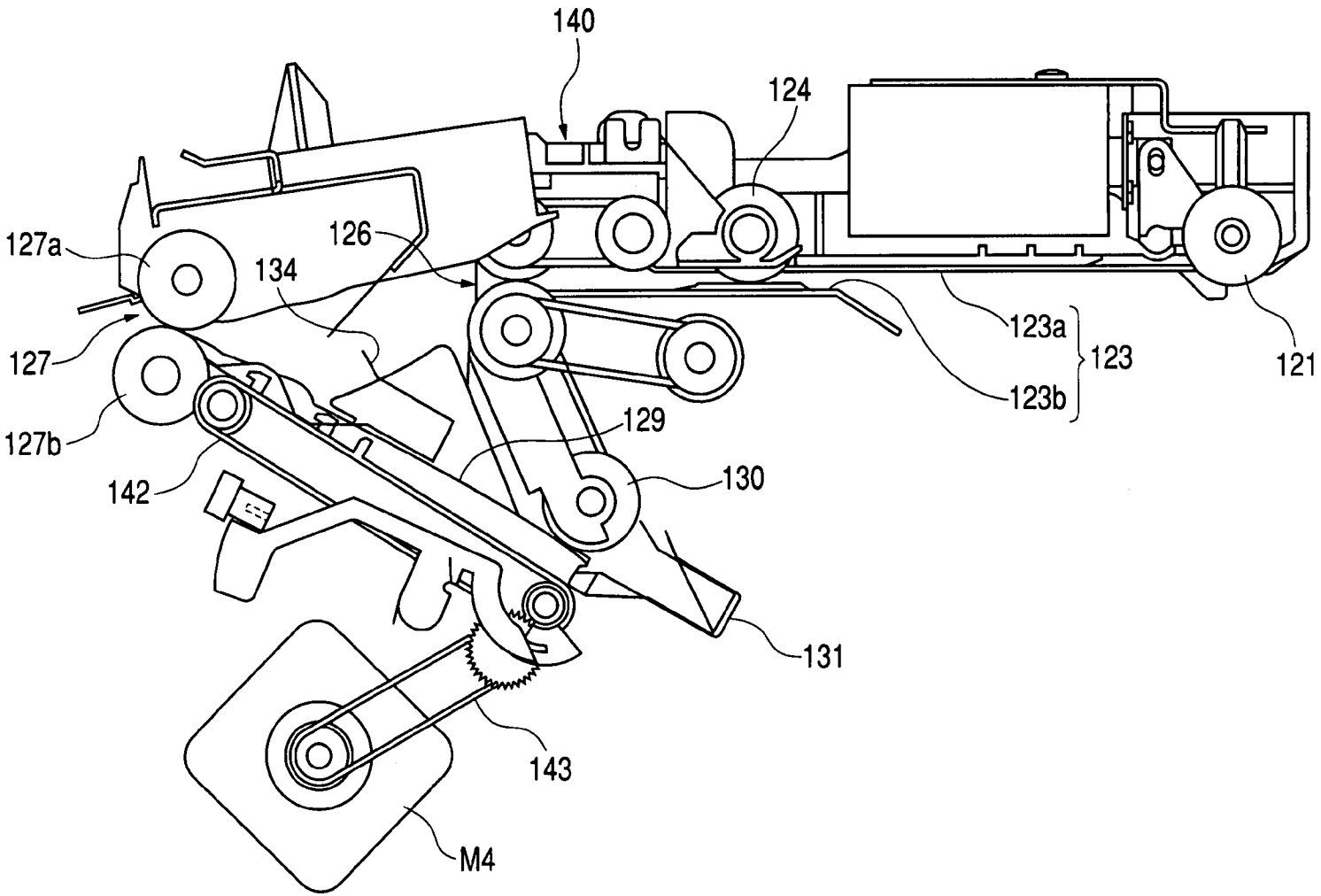
FIG. 7 shows a state in which the trailing edge assist has been further moved from the state shown in FIG. 6.
Figure 18B:
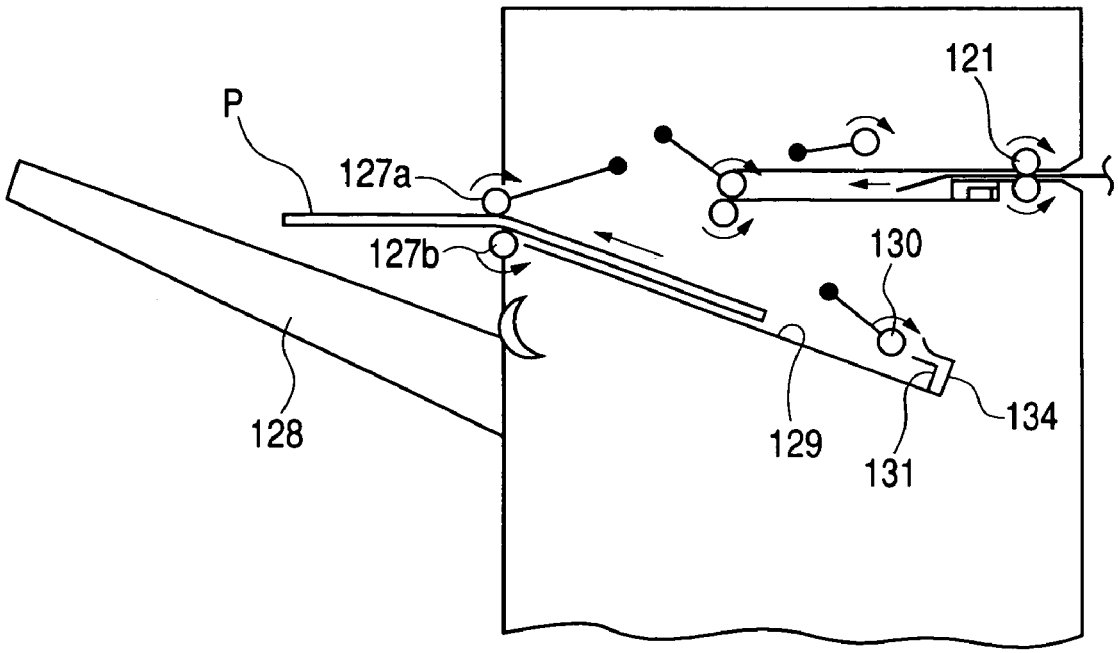

As shown in FIG. 18B, the upper roller 127*a* and the lower roller 127*b* rotates in the direction shown by arrows with the sheet stack P being held between them, while the trailing edge assist 134 pushes the trailing edge of the sheet stack P. Thus, the sheet stack P is discharged onto the stack tray 128. The trailing edge assist 134 is provided on a belt 142 that is moved back and forth by a trailing edge assist motor M4 as shown in FIGS. 5 to 7.

In the above-described operation, if as shown in FIGS. 10 and 11 the activation time (T1) and the initial speed (132 mm/sec) of the oscillation roller pair 127 and the trailing edge assist 134 are the same and they reach the same acceleration termination speed (500 mm/sec) at the same time (T2), the oscillation roller pair 127 and the trailing edge assist 134 can discharge the sheet stack without applying a tensile or compressive force to the sheet stack (S106).

However, in some cases as shown in FIG. 11, the initial speed of the trailing edge assist 134 (here, assumed to be 300 mm/sec) is higher (under the aforementioned assumption) than the initial speed of the oscillation roller pair 127 on account of the belts 143 and 142 that transmit the rotational force of the trailing edge assist motor M4 to the trailing edge assist 134 or other members. In that case, commencement of the movement of the trailing edge assist 134 is suspended until the time T3 at which the sheet conveying speed of the oscillation roller pair 127 reaches 300 mm/sec and the movement of the trailing edge assist 134 is started when the sheet conveying speed of the oscillation roller 127 is reached. Specifically, the movement of the trailing edge assist 134 is started the time ΔT=(T3−T1) after the oscillation roller pair 127 is activated (S107). In connection with this, in the case that the initial speed of the oscillation roller pair 127 is higher than the initial speed of the trailing edge assist 134, the activation time of the oscillation roller pair 127 is delayed by ΔT to the contrary. In the case that the initial speed of the oscillation roller pair 127 and the initial speed of the trailing edge assist 134 are the same, ΔT is zero.

With the difference ΔT in the activation time, the oscillation roller pair 127 and the trailing edge assist 134 can discharge the sheet stack without applying a tensile or compressive force to the sheet stack even if there is a difference in the initial speed between the oscillation roller pair 127 and the trailing edge assist 134. In addition, deterioration in quality of the sheet stack or in quality of images on the sheets in the stack due to a roller trace of the oscillation roller pair 127 can be avoided.

Figure 19:
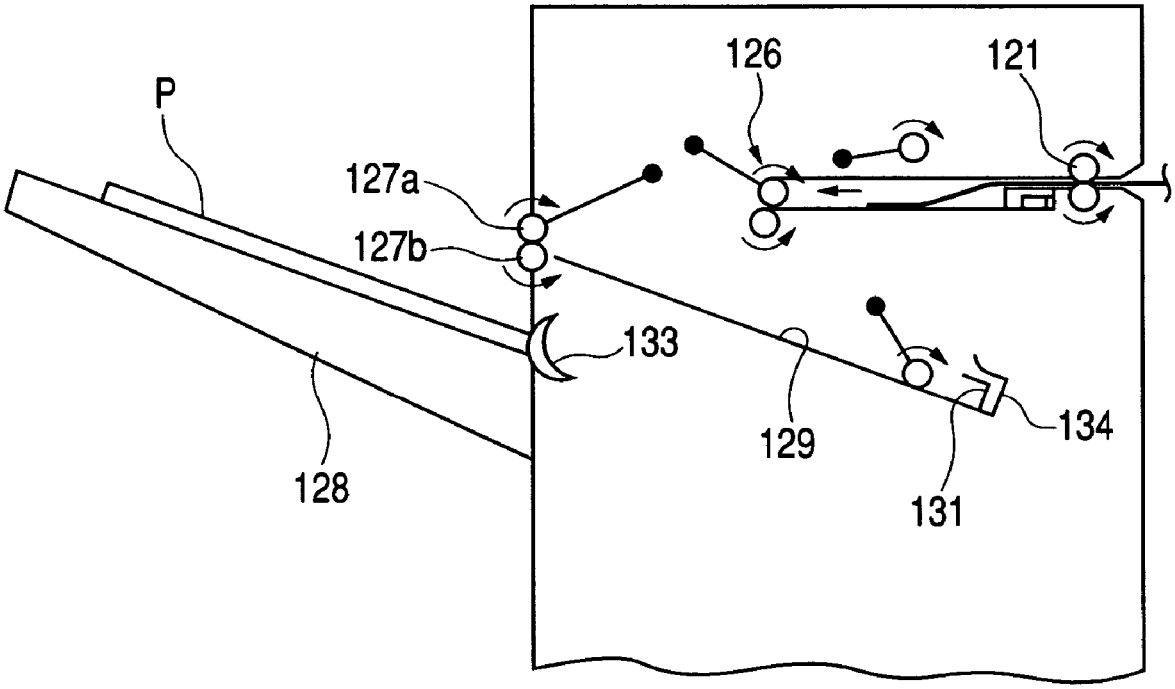
FIG. 19 illustrates the operation of the sheet processing apparatus in the case that sheets need not be stored during sheet processing and shows a state in which the sheet stack has been discharged from the processing tray to the stack tray.

The sheet discharge of the sheet stack toward the stack tray 128 is started by the oscillation roller pair 127, the trailing edge assist 134 and the return roller 130 (S108). When the trailing edge assist has been moved about 15 mm (S109), it is returned back to its original position (or the home position) (S110, which operation corresponds to HP delivery control shown in FIG. 12). The sheet stack is discharged onto the stack tray 128 by the oscillation roller pair 127 as shown in FIG. 19. After that, the sheet stack discharge action sequence is completed at the time when the upper roller 127*a* of the oscillation roller pair 127 is detached from the lower roller 127*b* (S111 and S112).

Referring to FIG. 18B, when discharge of a sheet stack is started, the first sheet of the next sheet stack has been delivered to the inlet roller pair 121.

In the sheet processing apparatus 119 according to this embodiment, since the trailing edge assist 134 is adapted to push the trailing edge of the sheet stack to convey it, the sheet stack can be conveyed reliably without the surface of the sheet stack being damaged unlike the case in which the sheet stack is discharge by a rotating roller that is pressed against the surface of the sheet stack.

(Description of Buffer Operation)

The above description has been directed to the case in which for example the conveyance interval between sheets is so large that the stapling operation can be performed on a sheet stack while the next sheet is delivered. On the other hand, the following description will be directed to a buffer operation in which the conveyance interval between sheets is small and when the succeeding sheets are delivered while the stapling operation is performed on a sheet stack, the succeeding sheets are stored (i.e. buffered) during that stapling operation.

The sheet processing apparatus 119 performs the buffer operation based on a buffer operation command by the finisher control portion 211 when it is determined by the CPU circuit portion 200 that an interval between sheets delivered from the main body 101 of the copying machine 100 is shorter than the time required for the sheet stapling operation. In that case, the buffer roller 124 is lowered by the plunger SL1 (shown in FIG. 4) so as to be in contact with the lower conveyance guide plate 123*b*.

Figure 20A:
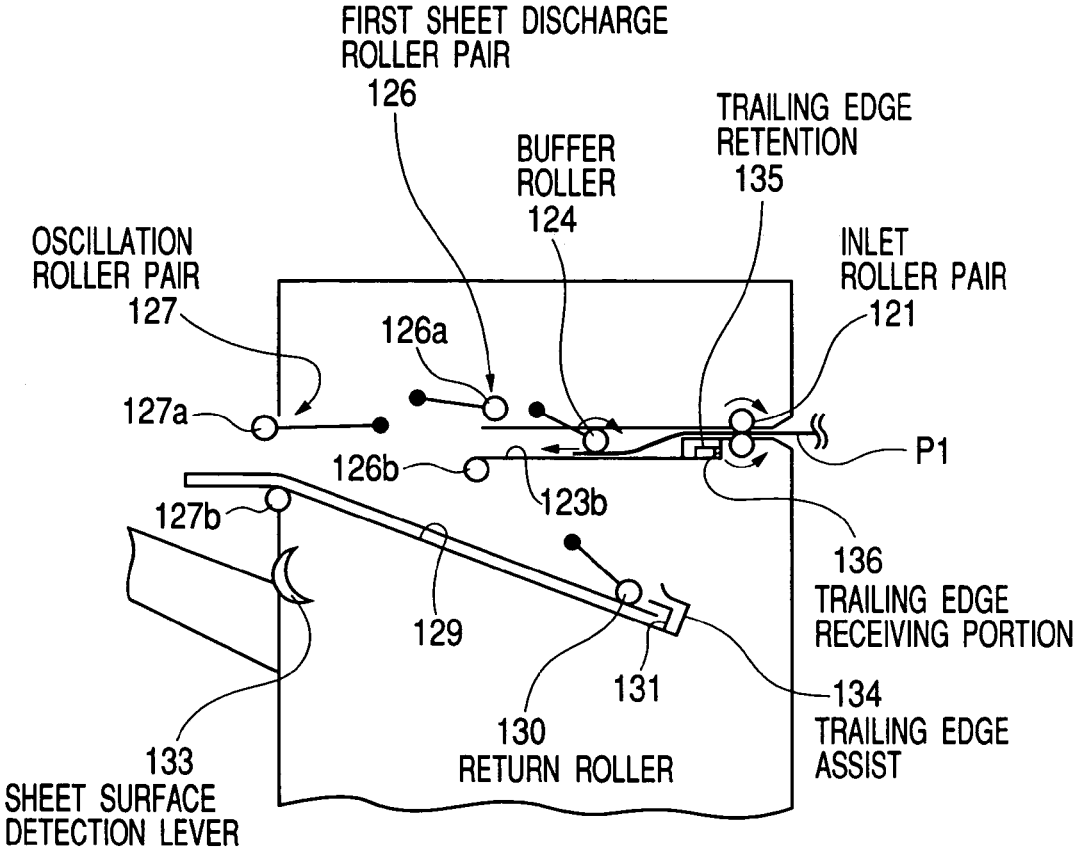
FIGS. 20A and 20B illustrate the operation of the sheet processing apparatus in the case that sheets are stored during sheet processing.
Figure 20B:
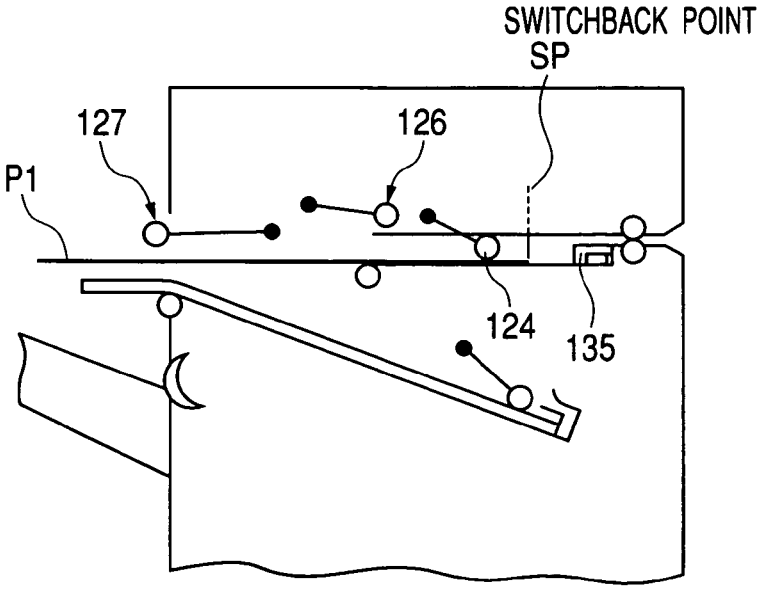

In FIGS. 20A and 20B, it is assumed that a sheet stack is present on the processing tray 129 and the stapling operation is performed on that sheet stack by the stapler units 132 (shown in FIGS. 3 and 4).

As shown in FIG. 20A, if the first sheet P1 of the next sheet stack is delivered while the stapling operation is performed on the sheet stack P on the processing tray 129, the sheet P1 is conveyed by the inlet roller pair 121 to the buffer roller 124. The buffer roller 124 is rotated by the inlet conveyance motor M2 (shown in FIG. 4) to convey the sheet P1 toward the downstream. At that time, the upper first sheet discharge roller pair 126*a* of the first sheet discharge roller pair 126 is kept away from the lower first sheet discharge roller pair 126*b* by a first sheet discharge roller separating plunger SL2 (see FIG. 4). It should be noted that the first sheet discharge roller separating plunger SL2 is not explicitly shown in FIG. 4 since it is eclipsed by the buffer roller separating plunger SL1 in FIG. 4. In addition, the upper roller 127*a* of the oscillation roller pair 127 is also kept away from the lower roller 127*b* by the plunger that is not shown in the drawings.

Figure 21A:
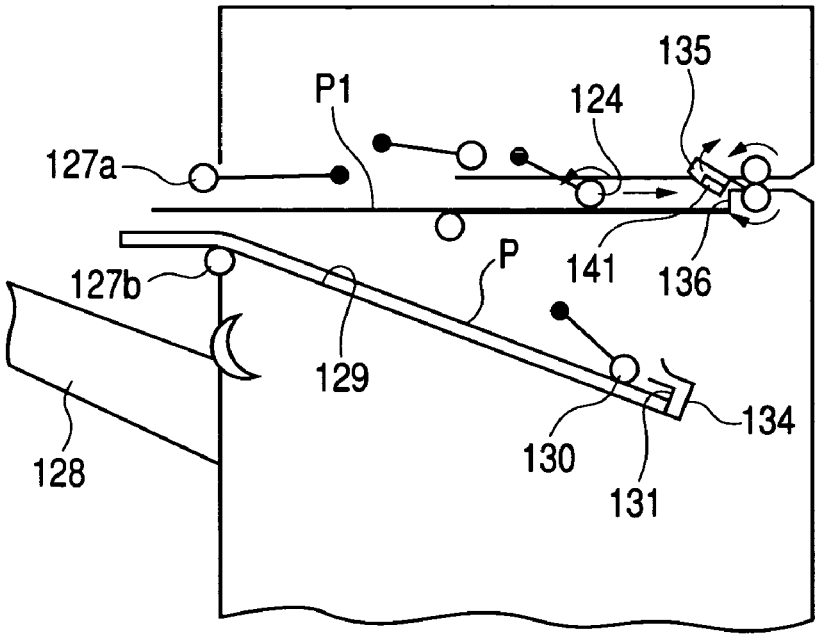
FIGS. 21A and 21B illustrate the operation of the sheet processing apparatus in the case that sheets are stored during sheet processing and show states that follow the states shown in FIGS. 20A and 20B.
Figure 21B:
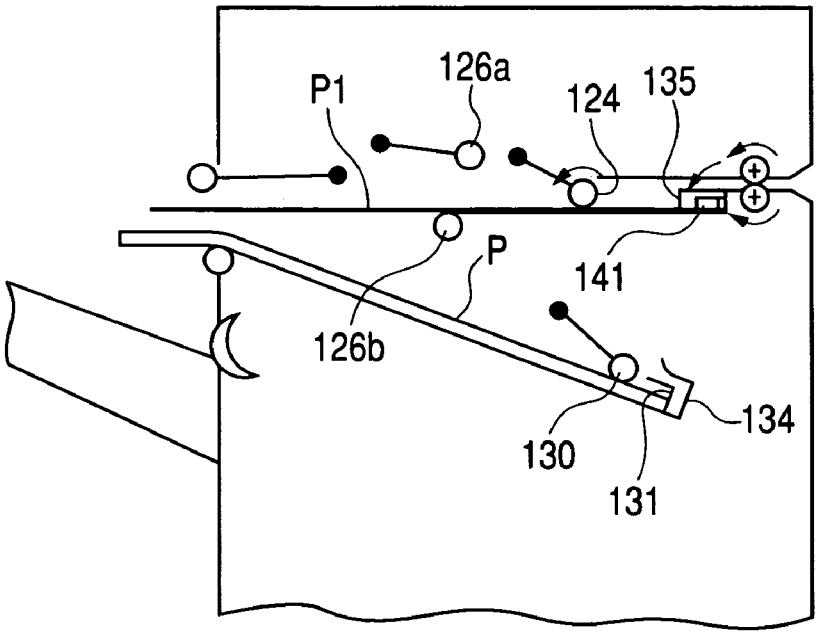

When the trailing edge of the sheet P1 reaches the switchback point SP as shown in FIG. 20B, the rotation of the buffer roller 124 is reversed so that the sheet P1 is returned toward the upstream as shown in FIG. 21A. At substantially the same time with this, a trailing edge retention 135 is detached from the lower conveyance guide plate 123*b*, so that a trailing edge receiving portion 136 is released. The apparatus is adapted to determine the arrival of the sheet P1 to the switchback point SP by counting a predetermined time or counting the rotation number of the buffer roller after an inlet path sensor S1 provided in the downstream vicinity of the inlet roller pair 121 shown in FIG. 4 is activated by the leading edge (i.e. the downstream edge) of the sheet P1.

After the downstream edge of the sheet P1 is detected, the upstream edge portion of the sheet P1 is received by the trailing edge receiving portion 136 as shown in FIG. 21A. Then, the trailing edge retention 135 is returned to the previous position, so that the sheet P1 is pressed against the lower conveyance guide plate 123*b* by a friction member 141 provided on the trailing edge retention 135.

Figure 22A:
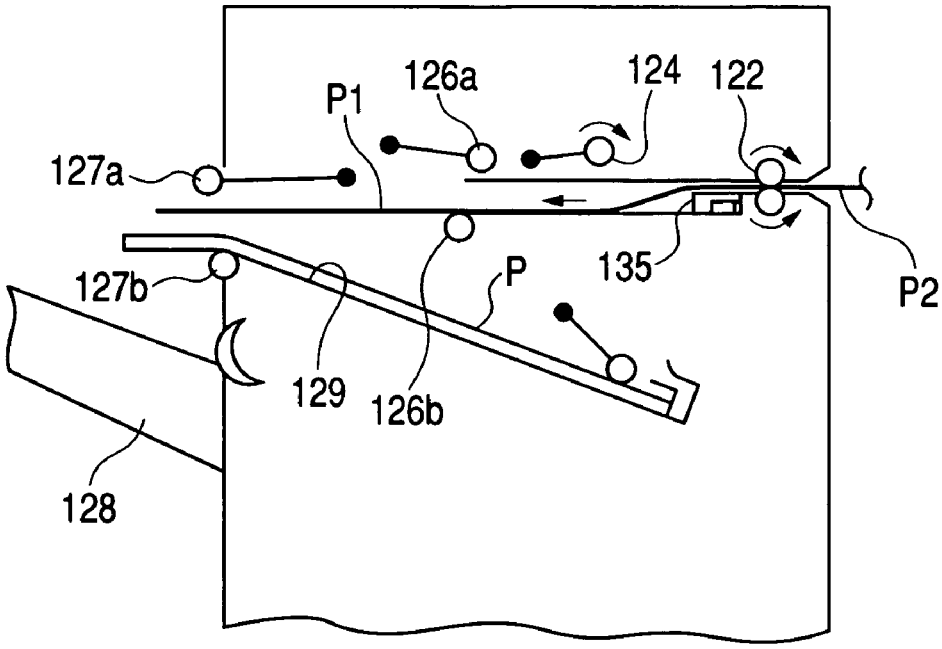
FIGS. 22A and 22B illustrate the operation of the sheet processing apparatus in the case that sheets are stored during sheet processing and show states that follow the states shown in FIGS. 21A and 21B.
Figure 22B:
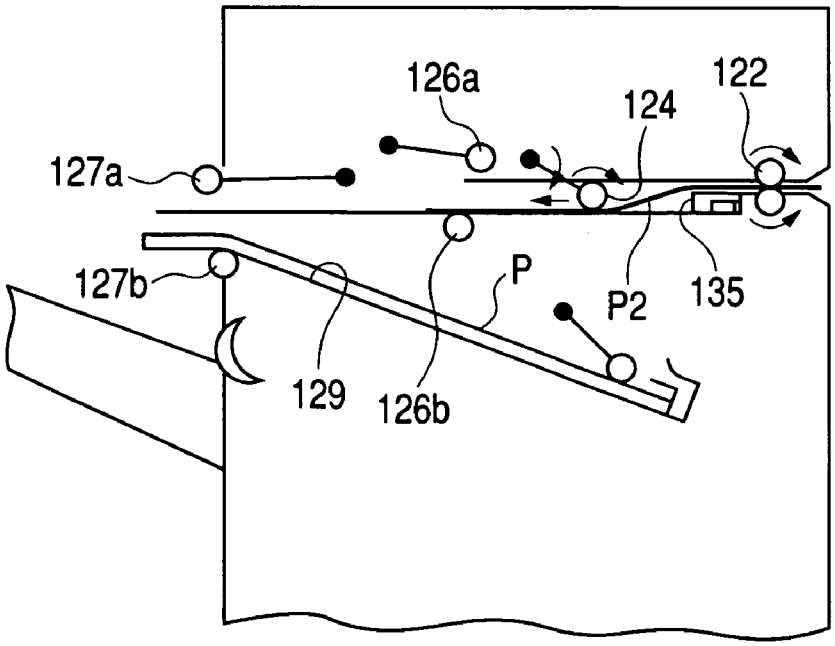

After that, the second sheet P2 is delivered as shown in FIG. 22A. The second sheet P is conveyed by the inlet roller pair 121. At that time, the sheet P2 is made to pass over the trailing edge retention 135. After that, the sheet P2 is conveyed also by the buffer roller 124 as shown in FIG. 22B.

At that time, the first sheet P1 is being pressed against the lower conveyance guide plate 123*b* together with the second sheet P2 by means of the buffer roller 124. Consequently, the first sheet P1 is disposed to follow the second sheet P2 under conveyance to move toward the downstream. However, the first sheet P1 is not actually moved, since it is pressed against the lower conveyance guide plate 123*b* by the friction member 141 provided on the trailing edge retention 135.

Figure 23A:
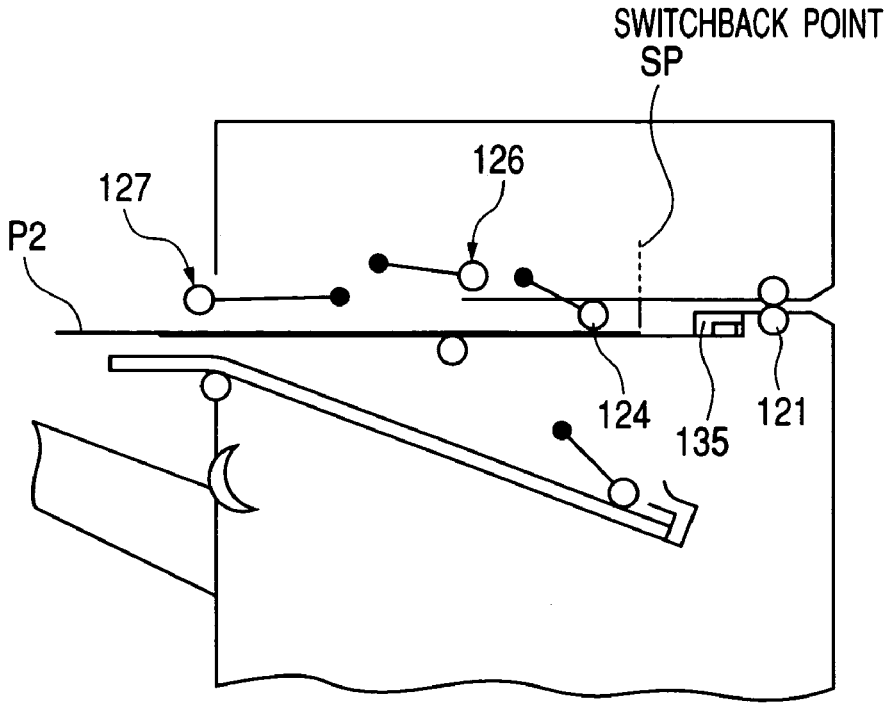
FIGS. 23A and 23B illustrate the operation of the sheet processing apparatus in the case that sheets are stored during sheet processing and show states that follow the states shown in FIGS. 22A and 22B.
Figure 23B:
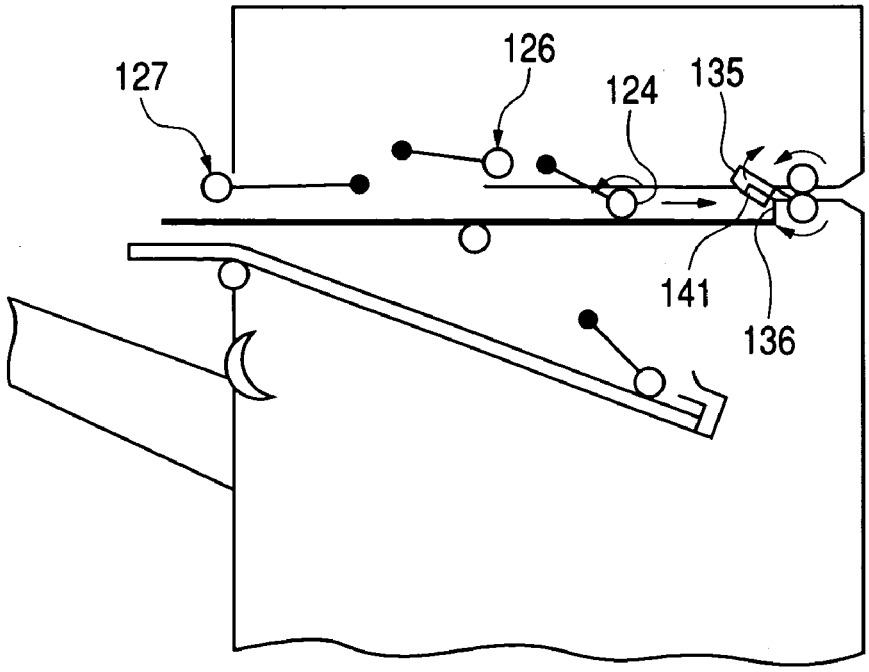
Figure 24:
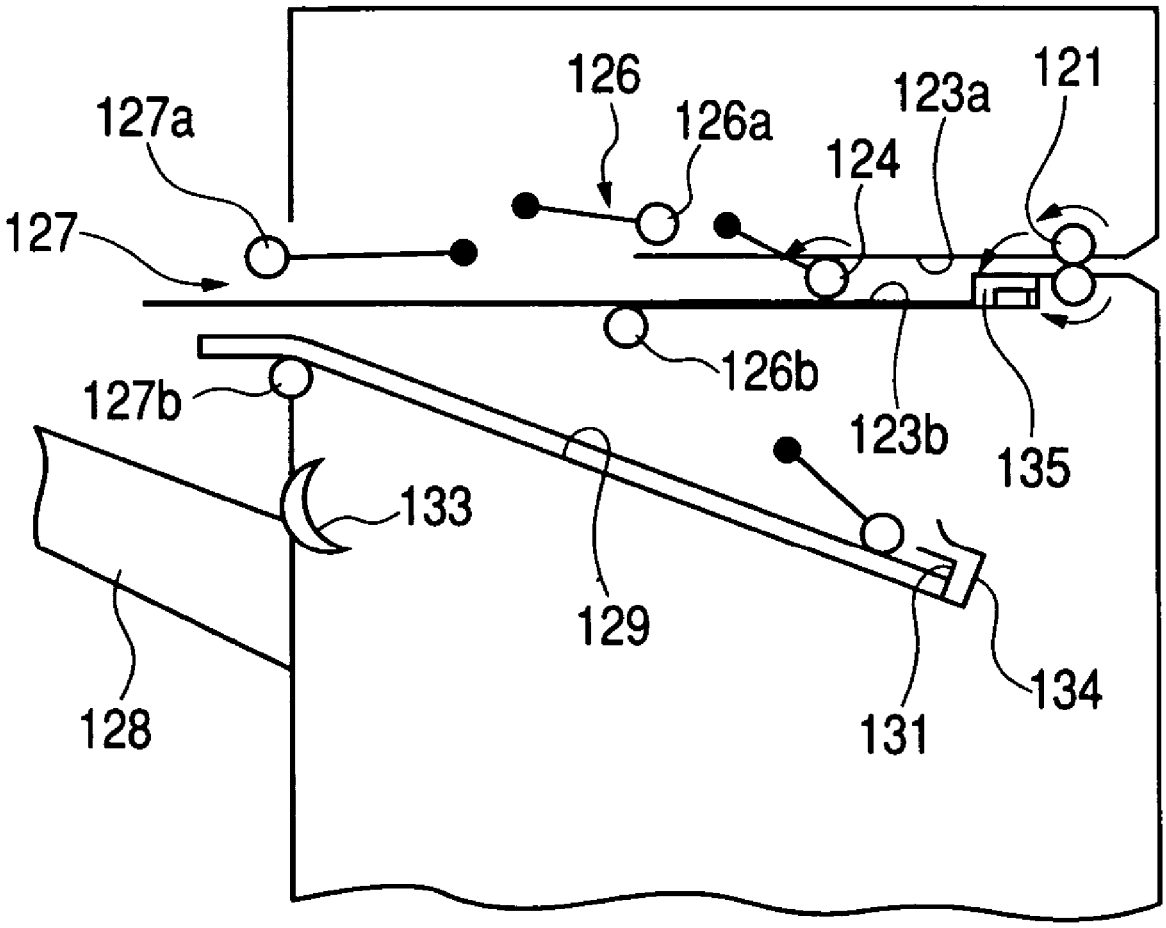
FIG. 24 illustrates the operation of the sheet processing apparatus in the case that sheets are stored during sheet processing and shows a state in which the first and second sheet overlapping with each other are pressed against the lower conveyance guide plate by the trailing edge retention.

The second sheet P2 is also returned toward the upstream when the trailing edge of the second sheet P2 reaches the switchback point SP as shown in FIGS. 23A, 23B and 24, in a manner similar to the first sheet P1. Then, the second sheet P2 is pressed against the lower conveyance guide plate 123*b* by the friction member 141 of the trailing edge retention 135 while overlapping the first sheet P1.

Figure 25A:
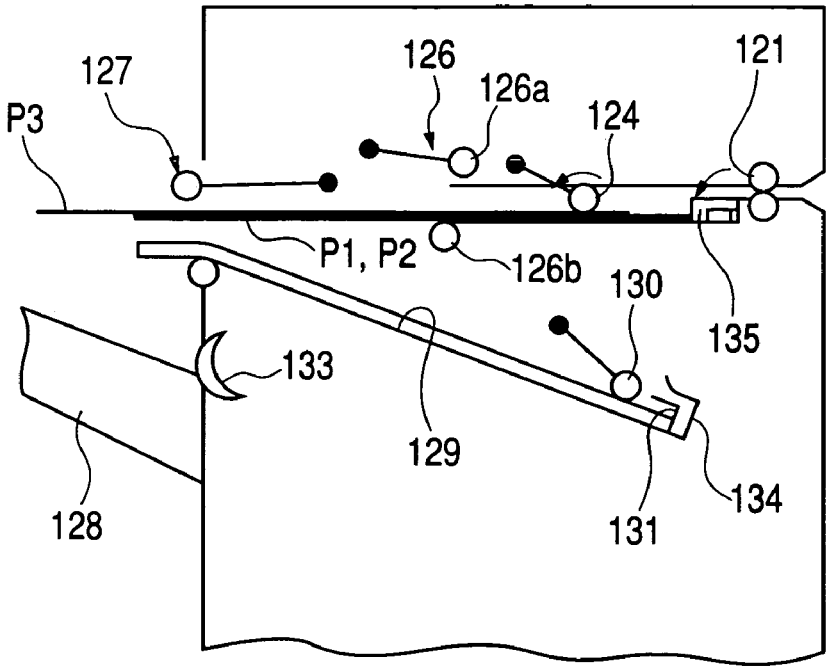
FIGS. 25A and 25B illustrate the operation of the sheet processing apparatus in the case that sheets are stored during sheet processing and show states that follow the state shown in FIG. 24.
Figure 25B:
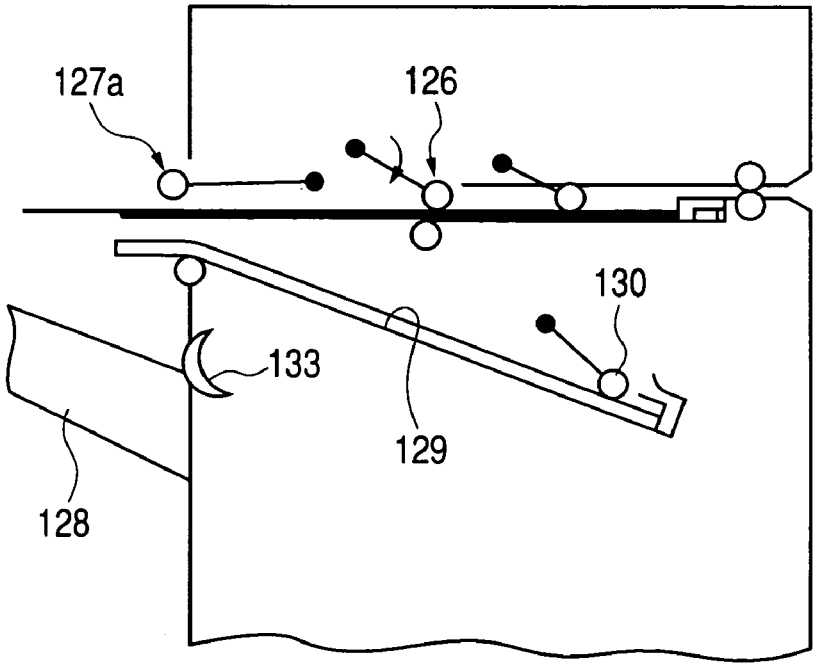
Figure 26A:
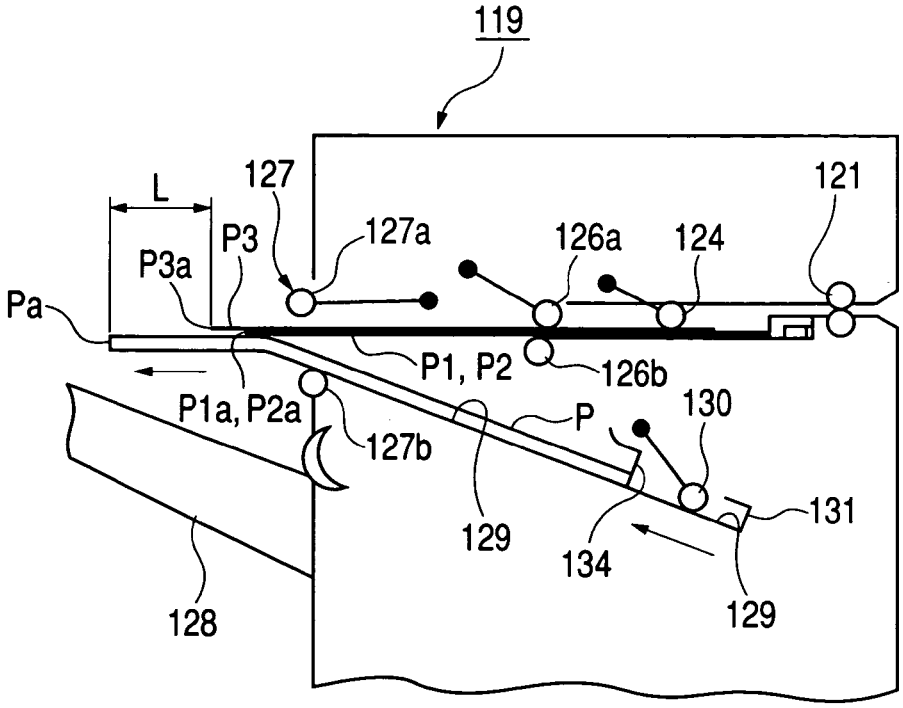
FIGS. 26A and 26B illustrate the operation of the sheet processing apparatus in the case that sheets are stored during sheet processing and show states that follow the states shown in FIGS. 25A and 25B.

After that, when the third sheet P3 is delivered and the trailing edge of the third sheet P3 passes through the inlet roller pair 121 as shown in FIG. 25A, so that the first to third sheets are held between the lower first sheet discharge roller pair 126*b* and the upper first sheet discharge roller pair 126*a* serving as the held sheet conveying portion as shown in FIG. 25B. Under this state, the third sheet P3 is displaced from the first and second sheets P1 and P2 a little in the downstream direction. Since the stapling operation on the sheet stack P on the processing tray 129 has been completed around that time, the trailing edge assist 134 is moved along the processing tray 129 to push up the trailing edge of the sheet stack P as shown in FIG. 26A. Consequently, the downstream edge Pa of the sheet stack P protrudes in the downstream direction beyond the downstream edge P3*a* of the third sheet P3 by length L.

Figure 26B:
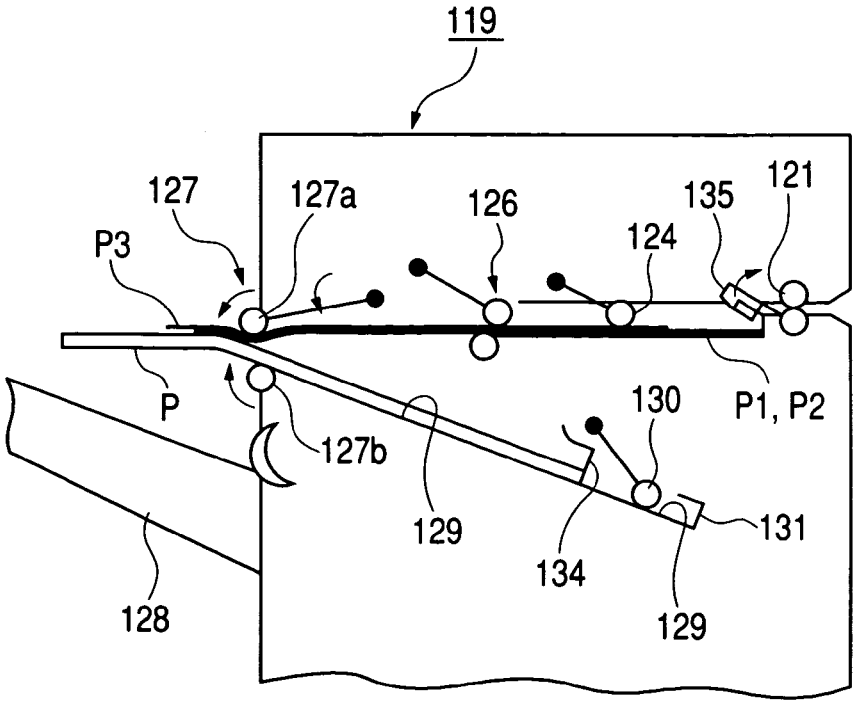

As shown in FIG. 26B, the upper roller 127*a* is also lowered and the three sheets P1, P2 and P3 are held between the upper roller 127*a* and the lower roller 127*b*. In conjunction with this, the trailing edge retention 135 is detached from the second sheet P2 to release the first sheet P1 and the second sheet P2.

Figure 27A:
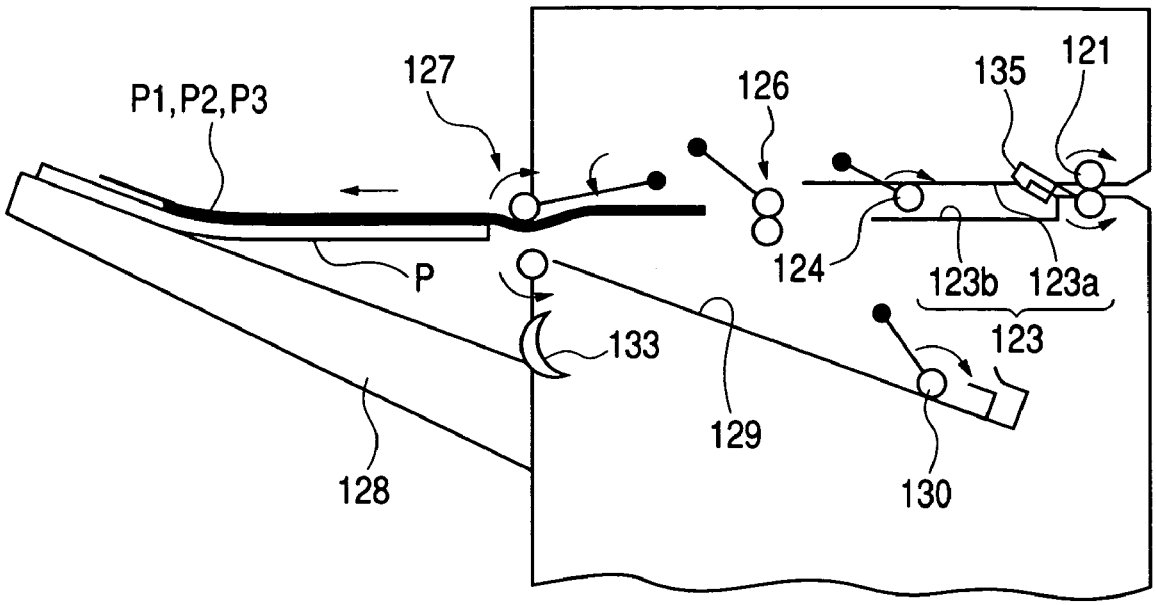
FIGS. 27A and 27B illustrate the operation of the sheet processing apparatus in the case that sheets are stored during sheet processing and show states that follow the states shown in FIGS. 26A and 26B.

After that, the three sheets P1, P2 and P3 and the sheet stack P are conveyed while held between the oscillation roller pair 127. When the sheet stack P is discharge onto the stack tray 128 as shown in FIGS. 27A and 27B, the trailing edge of the first sheet P and the second sheet P2 get out of the first sheet discharge roller pair 126 and the upstream side portion of the three sheets is received by the processing tray 129.

Figure 27B:
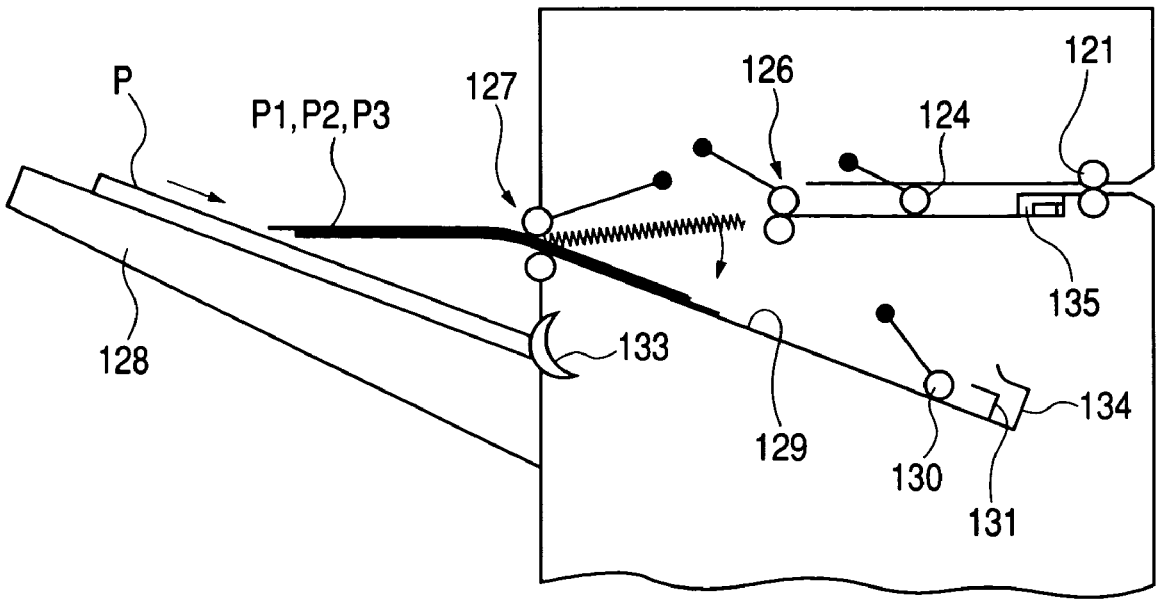

Under the state shown in FIG. 27B, if as shown in FIGS. 10 and 11 the activation time (T1) and the initial speed (132 mm/sec) of the first sheet discharge roller pair 126, the oscillation roller pair 127 and the trailing edge assist 134 are the same and they reach the same acceleration termination speed (500 mm/sec) at the same time (T2), the first sheet discharge roller pair 126, the oscillation roller pair 127 and the trailing edge assist 134 can discharge the sheet stack without applying a tensile or compressive force to the sheet stack or the three sheets. However, in the case that there is a difference in initial speed, the sheet stack can be discharged without any tensile or compressive force being applied to the sheet stack or the three sheets by setting a time difference for activation of the aforementioned portions in a manner similar to the process of S107 in the flow chart of FIG. 9. In addition, deterioration in quality of the sheet stack or in quality of images on the sheets in the stack on account of a roller trace of the first sheet discharge roller pair 126 or the oscillation roller pair 127 can be avoided.

Figure 28A:
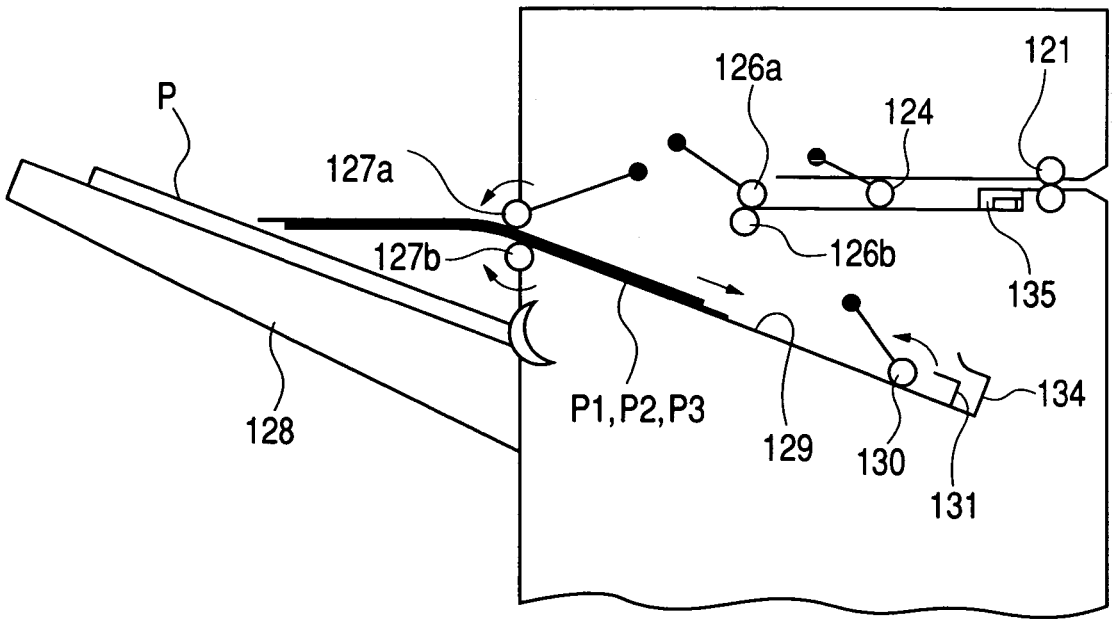
FIGS. 28A and 28B illustrate the operation of the sheet processing apparatus in the case that sheets are stored during sheet processing and show states that follow the states shown in FIGS. 27A and 27B.
Figure 28B:
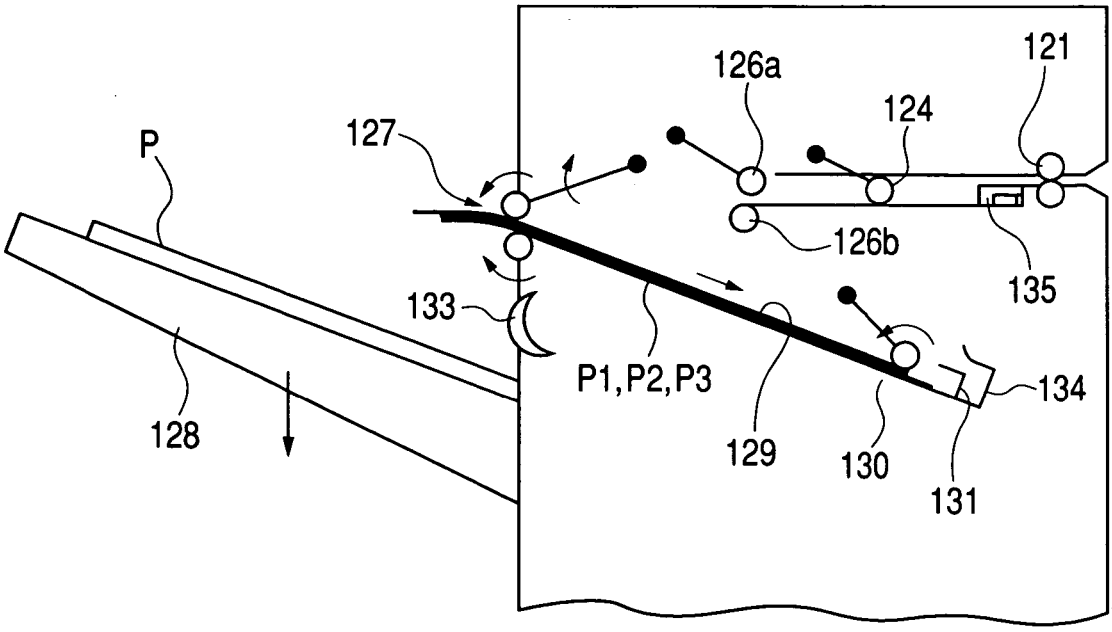
Figure 29:
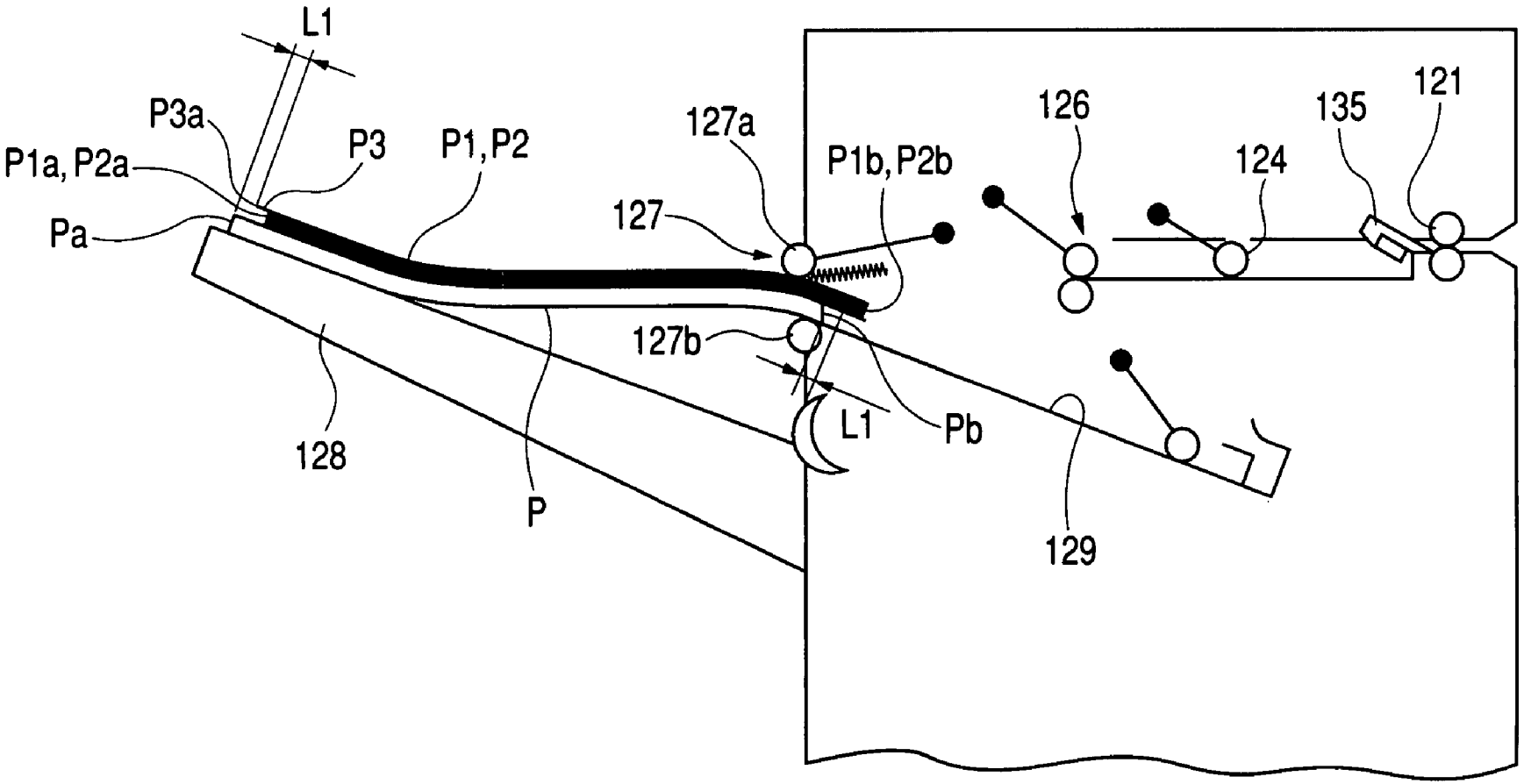
FIG. 29 illustrates the operation in the case that protrusion length of the downstream edge of the sheet stack beyond the downstream edge of the buffer sheet is short.

The three sheets are conveyed by the oscillation roller pair 127 and the return roller 130 to slide down on the processing tray 129 as shown in FIGS. 28A and 28B until received by the stopper 131. During this process, the stack tray 128 is once lowered so that the top surface of the sheet stack becomes lower than the sheet surface detection lever 133 and then elevated again. The elevation of the stack tray 128 is stopped when the sheet surface detection lever 133 is operated by the top surface of the sheet stack. Thus, the top surface of the sheet stack on the stack tray 128 is kept at a predetermined height. From then on, sheets are sequentially stacked onto the processing tray 129 without being stored on the lower conveyance guide plate 123*b*. When the number of the stacked sheets on the processing tray 129 reaches a predetermined value, they are stapled. During the stapling operation, the first three sheets of the next sheet stack are stored on the lower conveyance guide plate 123*b*.

Although the above description has been made with reference to the case in which three sheets are stored on the lower conveyance guide plate 123*b*, the number of the stored sheets (i.e. buffer sheets) is not limited to three, but it may be varied depending on the length of the sheets, the time required for the stapling operation, the sheet conveying speed or other factors.

As described in the foregoing, the sheet processing apparatus 119 according to this embodiment is designed in such a way that under the state shown in FIG. 26A, the downstream edge Pa of the sheet stack P protrudes beyond the downstream edge P3*a* of the third sheet P3 by length L. The reason for that design will be described in the following. In connection with this, it should be noted that the downstream edges P1*a* and P2*a* of the first and second sheets P1, P2 are at a position upstream of the downstream edge P3*a* of the third sheet P3.

If it is assumed that the protruding length of the downstream edge of the sheet stack P is L1 that is shorter than L, the protruding length of the upstream edge of the third sheet P3 is also L1. Therefore, the length of the portion at which the three buffer sheets are held by the oscillation roller pair 127 after the sheet stack P is discharged onto the stack tray 128 becomes short and the oscillation roller pair 127 might fail to hold the three buffer sheets. Thus, the three buffer sheets cannot be delivered to the processing tray 129 reliably. In view of this, the apparatus is constructed in such a way that the sheet stack P protrudes beyond the downstream edge P3*a* of the sheet P3 by length L so that the buffer sheets are held reliably by the oscillation roller pair 127 so as to be delivered to the processing tray 129.

In addition, if the aforementioned protruding length is short, the contact area of the buffer sheets and the sheet stack becomes large and the sheet stack is in close contact with the buffer sheets, so that falling of the sheet stack onto the stack tray 128 might be delayed. In that case, when the rotation of the oscillation roller pair 127 is reversed to convey the buffer sheets to the processing tray 129, the sheet stack might enter the oscillation roller pair 127 while closely attached to the buffer sheets, whereby the sheet stack might be damaged or jam might occur. In view of this, the apparatus is constructed in such a way that the sheet stack P protrudes beyond the downstream edge P3*a* of the sheet P3 by length L so that detachability of the sheet stack and the buffer sheets can be improved.

As per the above, the apparatus is constructed in such a way that after the sheet stack P stacked on the first sheet stacking means in the form of, for example, the processing tray 128 is conveyed by the second sheet conveying means in the form of, for example, the trailing edge assist 134 toward the second sheet stacking means in the form of, for example, the stack tray 128 by a predetermined amount, the buffer sheets P1, P2 and P3 held by the sheet holding means in the form of, for example, the buffer unit 140 and the sheets stacked on the processing tray 129 are conveyed simultaneously by the first sheet conveying means in the form of, for example, the oscillation roller pair 127 so as to be discharged onto the stack tray 128. Consequently, the overlapping area of the sheet stack and the buffer sheets is reduced by an amount corresponding to the predetermined conveyance amount (e.g. length L) of the sheet stack, and therefore the sheet stack can be detached from the buffer sheets reliably and discharged to be stacked onto the stack tray reliably.

Furthermore, the sheet processing apparatus is constructed in such a way that the trailing edge of the sheet stack is pushed by the trailing edge assist 134. In the case that the trailing edge of the sheet stack is pushed by the trailing edge assist 134 so as to be conveyed as above, the sheet can be conveyed reliably without the surface of the sheet being damaged, unlike the case in which the sheet is conveyed to be discharged by a rotating roller that is brought into pressure contact with the surface of the sheet stack.

Figure 30:
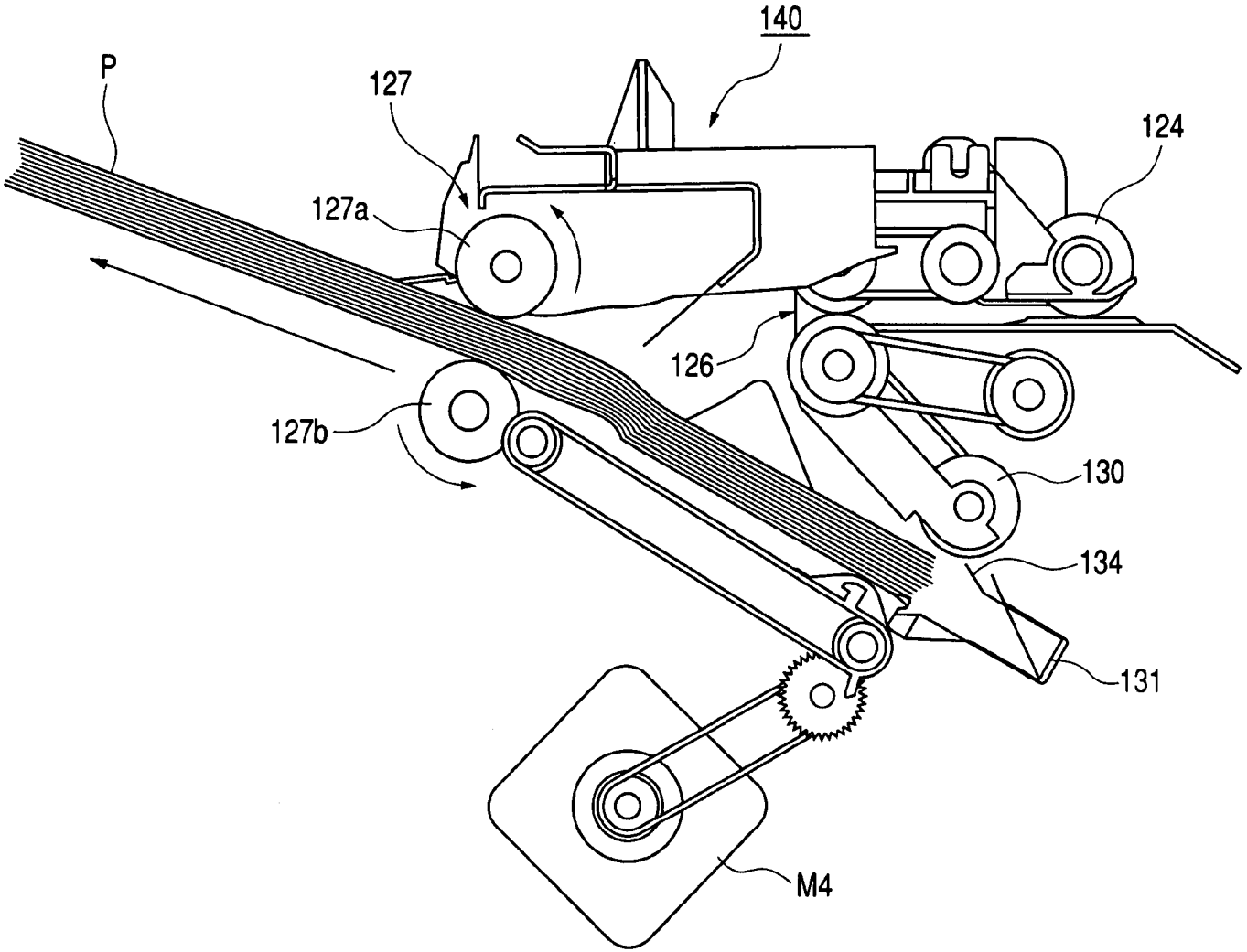
FIG. 30 illustrates a problem arising in the case that the sheet stack is discharged only by the oscillation roller pair.

Specifically, in the case that the sheet stack is discharged only by the oscillation roller 127 as shown in FIG. 30, the sheet conveyance amount might vary depending on a difference in the friction against sheet or the rotation speed between the upper roller 127*a* and the lower roller 127*b*, so that a displacement can occur between the upper portion and the lower portion of the sheets. If this occurs, slippage between the rotating oscillation roller pair 127 and the sheet might be caused to damage the sheet. In addition, the sheet stack as a whole might be twisted when discharged. In this case, the sheet stack cannot be discharged smoothly and the processing time will be elongated. Furthermore, if the sheet stack is twisted as a whole, there is the risk that the sheets are torn at the stapled portion to become useless.

The aforementioned events are liable to occur when the sheet stack holding pressure of the oscillation roller pair 127 is increased with a view to reliably discharge the sheet stack. In contrast, when the holding pressure is decreased, it is not possible to convey the sheet stack reliably. Therefore, it is difficult to set the holding pressure of the oscillation roller pair 127 appropriately.

In view of the above, the sheet processing apparatus is constructed in such a way that the sheet stack is discharged not only by the oscillation roller pair 127 but also the trailing edge assist 134. Thus, the aforementioned slippage of the rotating roller against the sheet or the twisting of the sheet stack can be avoided, so that the sheet stack can be discharged smoothly and quickly without the sheets or sheet stack being damaged. In addition the sheet stack can be discharged without need for strict control of the holding pressure of the oscillation roller pair 127.

Although the above description of the sheet processing apparatus has been made with reference to the case in which the buffer unit 140 for storing (or buffering) a plurality of sheets in a straight state during the operation of the stapler 132 is provided, the present invention can be applied to the apparatus provided with a buffer roller unit having a buffer roller 13 and a buffer roller path as shown in FIG. 31. Therefore, the present invention is not limited to the sheet processing apparatus provided with a buffer unit 140 adapted to store (or buffer) a plurality of stacked sheets in a straight state.

Although in the above description has been made with reference to the case in which the sheet position is detected by a sensor, the sheet position may be determined based on a sheet storage information (memory information) controlled in the CPU 221.

In addition, although the above sheet processing apparatus 129 is adapted to staple the sheet stack after trailing edge alignment and width alignment for aligning the sheet stack from both sides have been performed, the sheet stack may be discharged onto the stack tray 128 directly after the width alignment and the trailing edge alignment without being stapled.

What is claimed is:

1. A sheet processing apparatus comprising:

sheet holding means for holding a plurality of supplied sheets in a stack;

first sheet stacking means on which sheets that have been held by said sheet holding means are stacked;

second sheet stacking means, provided downstream of said first sheet stacking means with respect to a sheet conveying direction, on which sheets are stacked;

first sheet conveying means for discharging the sheets stacked on said first sheet stacking means to said second sheet stacking means; and second sheet conveying means for conveying the sheets stacked on said first sheet stacking means toward said second sheet stacking means;

wherein after the sheets stacked on said first sheet stacking means are conveyed by said second sheet conveying means toward said second sheet stacking means by a predetermined amount so that a downstream edge of the sheet stacked on said first sheet stacking means protrudes in a downstream side beyond a downstream edge of the sheets held by said sheet holding means, said first sheet conveying means conveys the sheets stacked on said first sheet stacking means and the sheets held by said sheet holding means to thereby discharge the sheets stacked on said first sheet stacking means to said second sheet stacking means and to stack the sheets held by said sheet holding means onto said first sheet stacking means.

2. A sheet processing apparatus according to claim 1, wherein said second sheet conveying means is adapted to push a trailing edge, with respect to the sheet conveying direction, of the sheets stacked on said first sheet stacking means to thereby convey those sheets.

3. A sheet processing apparatus according to claim 1, further comprising control means for controlling said second sheet conveying means in such a way that said second sheet conveying means conveys the sheets stacked on said first sheet stacking means until the downstream edge of those sheets protrude in the downstream side beyond the downstream edge of the sheets held by said sheet holding means by a predetermined amount.

4. A sheet processing apparatus according to claim 3, wherein said sheet holding means has a held sheet conveying portion for conveying said held sheets, and said control means controls sheet conveying speed of said held sheet conveying portion and sheet conveying speed of said first sheet conveying means in such a way as to make them equal.

5. A sheet processing apparatus according to claim 4, wherein said control means controls activation timing of said held sheet conveying portion and said first sheet conveying means in such a way that the sheet conveying speeds of them are made equal when the sheets are conveyed.

6. A sheet processing apparatus according to claim 3, wherein said control means controls sheet conveying speed of said first sheet conveying means and sheet conveying speed of said second sheet conveying speed in such a way to make them equal.

7. A sheet processing apparatus according to claim 6, wherein said control means controls activation timing of said first sheet conveying means and said second sheet conveying means in such a way that the sheet conveying speeds of them are made equal when the sheets are conveyed.

8. An image forming apparatus comprising:

image forming means for forming an image on a sheet; and a sheet processing apparatus for performing a processing on a sheet on which an image has been formed by said image forming means;

wherein said sheet processing apparatus comprises a sheet processing apparatus according to claim 1 or 2.

9. An image forming apparatus comprising:

image forming means for forming an image on a sheet;

a sheet processing apparatus according to claim 1 for performing a processing on a sheet on which an image has been formed by said image forming means; and control means for controlling said second sheet conveying means in such a way that said second sheet conveying means conveys the sheets stacked on said first sheet stacking means until the downstream edge of those sheets protrude in the downstream side beyond the downstream edge of the sheets held by said sheet holding means by a predetermined amount.

10. An image forming apparatus according to claim 9, wherein said sheet holding means has a held sheet conveying portion for conveying said held sheets, and said control means controls sheet conveying speed of said held sheet conveying portion and sheet conveying speed of said first sheet conveying means in such a way as to make them equal.

11. An image forming apparatus according to claim 10, wherein said control means controls activation timing of said held sheet conveying portion and said first sheet conveying means in such a way that the sheet conveying speeds of them are made equal when the sheets are conveyed.

12. An image forming apparatus according to claim 9, wherein said control means controls sheet conveying speed of said first sheet conveying means and sheet conveying speed of said second sheet conveying means in such a way as to make them equal.

13. An image forming apparatus according to claim 12, wherein said control means controls activation timing of said first sheet conveying means and said second sheet conveying means in such a way that the sheet conveying speeds of them are made equal when the sheets are conveyed.

14. A sheet processing apparatus comprising:

a buffer unit which holds a plurality of supplied sheets in a stack;

a processing tray on which sheets have been held by said buffer unit;

a sheet stacker, provided downstream of said processing tray with respect to a sheet conveying direction, on which sheets are to be stacked;

sheet discharging rotary member which discharges the sheets stacked on said processing tray to said sheet stacker;

discharging assist member which conveys the sheets stacked on said processing tray toward said sheet stacker and;

wherein a controller after the sheets stacked on said processing tray are conveyed by said discharging assist member toward said sheet stacker by a predetermined amount so that a downstream edge of the sheet stacked on said processing tray protrudes in a downstream side beyond a downstream edge of the sheets held by said buffer unit, said sheet discharging rotary member conveys the sheets stacked on said processing tray and the sheets held by said buffer unit to thereby discharge the sheets stacked on said processing tray to said sheet stacker and to stack the sheets held by said buffer unit onto said processing tray.

15. A sheet processing apparatus according to claim 14, wherein said discharging assist member is adapted to push a trailing edge, with respect to the sheet conveying direction, of the sheets stacked on said processing tray to thereby convey those sheets.

16. A sheet processing apparatus according to claim 14 or 15, wherein said controller controls said discharging assist member in such a way that said discharging assist member conveys the sheets stacked on said processing tray until the downstream edge of those sheets protrude in the downstream side beyond the downstream edge of the sheets held by said buffer unit by a predetermined amount.

17. A sheet processing apparatus according to claim 16, wherein said buffer unit has a held sheet conveying portion for conveying said held sheets, and said controller controls sheet conveying speed of said held sheet conveying portion and sheet conveying speed of said sheet discharging rotary member in such a way as to make them equal.

18. A sheet processing apparatus according to claim 17, wherein said controller controls activation timing of said held sheet conveying portion and said sheet discharging rotary member in such a way that the sheet conveying speeds of them are made equal when the sheets are conveyed.

19. A sheet processing apparatus according to claim 16, wherein said controller controls sheet conveying speed of said sheet discharging rotary member and sheet conveying speed of said discharging assist member in such a way as to make them equal.

20. A sheet processing apparatus according to claim 19, wherein said controller controls activation timing of said sheet discharging rotary member and said discharging assist member in such a way that the sheet conveying speeds of them are made equal when the sheets are conveyed.

21. An image forming apparatus comprising:

image forming means for forming an image on a sheet; and a sheet processing apparatus for performing a processing on a sheet on which an image has been formed by said image forming means;

wherein said sheet processing apparatus comprises a sheet processing apparatus according to claim 14 or 15.

22. An image forming apparatus comprising:

image forming means for forming an image on a sheet;

a sheet processing apparatus according to claim 14 or 15 for performing a processing on a sheet on which an image has been formed by said image forming means;

wherein said controller controls said discharging assist member in such a way that said discharging assist member conveys the sheets stacked on said processing tray until the downstream edge of those sheets protrude in the downstream side beyond the downstream edge of the sheets held by said buffer unit by a predetermined amount.

23. An image forming apparatus according to claim 22, wherein said buffer unit has a held sheet conveying portion for conveying said held sheets, and said controller controls sheet conveying speed of said held sheet conveying portion and sheet conveying speed of said sheet discharging rotary member in such a way as to make them equal.

24. An image forming apparatus according to claim 23, wherein said controller controls activation timing of said held sheet conveying portion and said sheet discharging rotary member in such a way that the sheet conveying speeds of them are made equal when the sheets are conveyed.

25. An image forming apparatus according to claim 22, wherein said controller controls sheet conveying speed of said sheet discharging rotary member and sheet conveying speed of said discharging assist member in such a way as to make them equal.

26. An image forming apparatus according to claim 25, wherein said controller controls activation timing of said sheet discharging rotary member and said discharging assist member in such a way that the sheet conveying speeds of them are made equal when the sheets are conveyed.

* * * * *

UNITED STATES PATENT AND TRADEMARK OFFICE

CERTIFICATE OF CORRECTION

PATENT NO. : 7,165,764 B2
APPLICATION NO. : 10/790001
DATED : January 23, 2007
INVENTOR(S) : Tomokazu Nakamura et al.

It is certified that error appears in the above-identified patent and that said Letters Patent is hereby corrected as shown below:

ON THE TITLE PAGE, AT ITEM (57), Abstract:
Line 8, “sheet” should read --sheets--.

COLUMN 2:
Line 1, “stable.” should read --stably.--.
Line 52, “stacking.” should read --stacking--.

COLUMN 3:

Line 24, “processing” should be deleted.

COLUMN 5:
Line 17, “sheet” should read --sheets--.

COLUMN 6:
Line 42, “side” should read --sides--.

COLUMN 7:
Line 24, “an” should read --a--.

COLUMN 8:
Line 59, “a” should read --an--.
Line 66, “stock” should read --stack--.

COLUMN 11:
Line 17, “ΔT to the contrary.” In” should read --ΔT. To the contrary, in--.
Line 49, “discharge” should read --discharged--.

COLUMN 13:
Line 25, “discharge” should read --discharged--.

COLUMN 15:
Line 49, “in” should be deleted.

COLUMN 16:
Line 51, “second sheet conveying speed” should read --second sheet conveying means--.
Line 52, “to” should read --as to--.

UNITED STATES PATENT AND TRADEMARK OFFICE

CERTIFICATE OF CORRECTION

PATENT NO. : 7,165,764 B2
APPLICATION NO. : 10/790001
DATED : January 23, 2007
INVENTOR(S) : Tomokazu Nakamura et al.

It is certified that error appears in the above-identified patent and that said Letters Patent is hereby corrected as shown below:

COLUMN 17:
Line 37, "unit;" should read --unit are stacked;--.
Line 47, "wherein a controller" should read --a controller wherein--.

COLUMN 18:
Line 34, "sheet;" should read --sheet; and--.

Signed and Sealed this

Twenty-sixth Day of June, 2007

JON W. DUDAS
*Director of the United States Patent and Trademark Office*

UNITED STATES PATENT AND TRADEMARK OFFICE

CERTIFICATE OF CORRECTION

PATENT NO. : 7,165,764 B2
APPLICATION NO. : 10/790001
DATED : January 23, 2007
INVENTOR(S) : Tomokazu Nakamura et al.

It is certified that error appears in the above-identified patent and that said Letters Patent is hereby corrected as shown below:

On the title page Item (73) Assignee, please add: CANON FINETECH INC.

Signed and Sealed this

Twenty-seventh Day of January, 2009

JOHN DOLL
*Acting Director of the United States Patent and Trademark Office*